US007117734B2

(12) United States Patent
Follini et al.

(10) Patent No.: US 7,117,734 B2
(45) Date of Patent: Oct. 10, 2006

(54) METHOD FOR MEASURING FORMATION PROPERTIES WITH A TIME-LIMITED FORMATION TEST

(75) Inventors: Jean-Marc Follini, Houston, TX (US); Julian Pop, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 106 days.

(21) Appl. No.: 10/989,224

(22) Filed: Nov. 15, 2004

(65) Prior Publication Data

US 2005/0087009 A1 Apr. 28, 2005

Related U.S. Application Data

(62) Division of application No. 10/237,394, filed on Sep. 9, 2002, now Pat. No. 6,832,515.

(51) Int. Cl.
*E21B 47/10* (2006.01)
*E21B 49/08* (2006.01)

(52) U.S. Cl. ..... 73/152.41; 73/152.02; 73/152.24; 166/264; 166/250.01; 166/100

(58) Field of Classification Search ..... 73/152.02, 73/152.24, 152.37, 152.41, 152.51; 166/100, 166/250.01, 264
See application file for complete search history.

(56) References Cited

U.S. PATENT DOCUMENTS

| | | | |
|---|---|---|---|
| 3,321,965 | A | 5/1967 | Johnson et al. |
| 3,352,361 | A | 11/1967 | Urbanosky |
| 3,448,611 | A | 6/1969 | Lebourg |
| 3,811,321 | A | 5/1974 | Urbanosky |
| 3,859,851 | A | 1/1975 | Urbanosky |
| 3,898,877 | A | 8/1975 | McArthur |
| 4,416,152 | A | 11/1983 | Wilson |
| 4,507,957 | A | 4/1985 | Montgomery et al. |
| 4,513,612 | A | 4/1985 | Shalek |
| 4,597,290 | A | 7/1986 | Bourdet et al. |
| 4,742,459 | A | 5/1988 | Lasseter |
| 4,745,802 | A | 5/1988 | Purfurst |
| 4,803,873 | A | 2/1989 | Ehlig-Economides |

(Continued)

FOREIGN PATENT DOCUMENTS

EP 0 125 164 A1 11/1984

(Continued)

OTHER PUBLICATIONS

Goode et al, "Multiple Probe Formation Testing and Vertical Reservoir Continuity", SPE 22738, prepared for presentation at the 1991 Society of Petroleum Engineers Annual Technical Conference and Exhibition, held at Dallas, Tex. on Oct. 6-9, 1991.*

(Continued)

*Primary Examiner*—David Bagnell
*Assistant Examiner*—Shane Bomar
(74) *Attorney, Agent, or Firm*—Matthias Abrell; Victor H. Segura

(57) ABSTRACT

An apparatus and method for determining at least one downhole formation property is disclosed. The apparatus includes a probe and a pretest piston positionable in fluid communication with the formation, and a series of flowlines pressure gauges, and valves configured to selectively draw into the apparatus for measurement of one of formation fluid and mud. The method includes performing a first pretest to determine an estimated formation parameter; using the first pretest to design a second pretest and generate refined formation parameters whereby formation properties may be estimated.

5 Claims, 10 Drawing Sheets

U.S. PATENT DOCUMENTS

| | | | | |
|---|---|---|---|---|
| 4,843,878 | A | | 7/1989 | Purfurst et al. |
| 4,879,900 | A | | 11/1989 | Gilbert |
| 4,890,487 | A | | 1/1990 | Dussan V. et al. |
| 4,936,139 | A | | 6/1990 | Zimmerman et al. |
| 4,949,575 | A | | 8/1990 | Rasmus |
| 4,953,399 | A | | 9/1990 | Ferti et al. |
| 5,095,745 | A | | 3/1992 | Desbrandes |
| 5,144,589 | A | | 9/1992 | Hardage |
| 5,184,508 | A | | 2/1993 | Desbrandes |
| 5,230,244 | A | | 7/1993 | Gilbert |
| 5,233,866 | A | | 8/1993 | Desbrandes |
| 5,233,868 | A | | 8/1993 | Coats et al. |
| 5,247,830 | A | | 9/1993 | Goode |
| 5,265,015 | A | | 11/1993 | Auzerais et al. |
| 5,269,180 | A | | 12/1993 | Dave et al. |
| 5,303,582 | A | | 4/1994 | Miska |
| 5,329,811 | A | | 7/1994 | Schultz et al. |
| 5,335,542 | A | | 8/1994 | Ramakrishnan et al. |
| 5,353,637 | A | | 10/1994 | Plumb et al. |
| 5,517,854 | A | | 5/1996 | Plumb et al. |
| 5,555,945 | A | | 9/1996 | Schultz et al. |
| 5,602,334 | A | | 2/1997 | Proett et al. |
| 5,635,631 | A | | 6/1997 | Yesudas et al. |
| 5,644,076 | A | * | 7/1997 | Proett et al. ..... 73/152.41 |
| 5,703,286 | A | | 12/1997 | Proett et al. |
| 5,708,204 | A | * | 1/1998 | Kasap ..... 73/152.52 |
| 5,741,962 | A | | 4/1998 | Birchak et al. |
| 5,770,798 | A | | 6/1998 | Georgi et al. |
| 5,789,669 | A | | 8/1998 | Flaum |
| 5,799,733 | A | | 9/1998 | Ringgenberg et al. |
| 5,803,186 | A | | 9/1998 | Berger et al. |
| 5,934,374 | A | | 8/1999 | Hrametz et al. |
| 5,959,203 | A | | 9/1999 | Ajjoul |
| 5,969,241 | A | | 10/1999 | Auzerais |
| 6,006,834 | A | | 12/1999 | Skinner |
| 6,026,915 | A | | 2/2000 | Smith et al. |
| 6,047,239 | A | | 4/2000 | Berger et al. |
| 6,058,773 | A | | 5/2000 | Zimmerman et al. |
| 6,147,437 | A | | 11/2000 | Matsumoto et al. |
| 6,157,032 | A | | 12/2000 | Into |
| 6,157,893 | A | | 12/2000 | Berger et al. |
| 6,176,323 | B1 | | 1/2001 | Weirich et al. |
| 6,178,815 | B1 | | 1/2001 | Felling et al. |
| 6,230,557 | B1 | | 5/2001 | Ciglenec et al. |
| 6,236,620 | B1 | | 5/2001 | Schultz et al. |
| 6,325,146 | B1 | | 12/2001 | Ringgenberg et al. |
| 6,334,489 | B1 | | 1/2002 | Shwe et al. |
| 6,340,062 | B1 | | 1/2002 | Skinner |
| 6,343,507 | B1 | | 2/2002 | Felling et al. |
| 6,343,650 | B1 | | 2/2002 | Ringgenberg et al. |
| 6,427,530 | B1 | | 8/2002 | Krueger et al. |
| 6,474,152 | B1 | | 11/2002 | Mullins et al. |
| 6,609,568 | B1 | | 8/2003 | Krueger et al. |
| 6,672,386 | B1 | | 1/2004 | Krueger et al. |
| 6,758,090 | B1 | | 7/2004 | Bostrom et al. |
| 6,761,062 | B1 | | 7/2004 | Shapiro |
| 6,832,515 | B1 | | 12/2004 | Follini et al. |
| 6,843,118 | B1 | | 1/2005 | Weintraub et al. |
| 6,932,167 | B1 | | 8/2005 | Proett et al. |
| 2002/0060094 | A1 | | 5/2002 | Meister et al. |
| 2002/0112854 | A1 | * | 8/2002 | Krueger et al. ..... 166/250.07 |
| 2003/0094040 | A1 | | 5/2003 | Proett et al. |
| 2003/0214879 | A1 | * | 11/2003 | Proett et al. ..... 367/81 |
| 2004/0045706 | A1 | | 3/2004 | Pop et al. |
| 2004/0221983 | A1 | | 11/2004 | Ma et al. |
| 2004/0231842 | A1 | * | 11/2004 | Shammai et al. ..... 166/264 |
| 2006/0042372 | A1 | * | 3/2006 | Sheng et al. ..... 73/152.41 |

FOREIGN PATENT DOCUMENTS

| | | |
|---|---|---|
| EP | 0490421 | 11/1991 |
| EP | 610098 | 2/1994 |
| EP | 0520903 | 10/1995 |
| EP | 0698722 | 12/2002 |
| WO | WO 01/33044 | 11/1999 |
| WO | WO 02/08570 A1 | 7/2000 |

OTHER PUBLICATIONS

Karstad, Eirik et al., "Density Behavior of Drilling Fluids During High Pressure High Temperature Drilling Operations," SPE 47806, Sep. 1998, pp. 227-237.

Kasap, E. et al., Robust and Simple Graphical Solution for Wireline Formation Tests: Combined Breakdown and Buildup Analyses, SPE 36525, pp. 343-357.

Lee, Jaedong et al., Enhanced Wireline Formation Tests in Low-Permeability Formations: Quality through Formation Rate Analysis, SPE 60293, pp. 1-7.

Joseph, Jeffrey A. et al., Unsteady-State Spherical Flow with Storage and Skin, Society of Petroleum Engineers Journal, Dec. 1985, pp. 804-822.

Proett, Mark A. et al., Supercharge Pressure Compensation with New Wireline Formation Testing Method, SPWLA 37th Annual Logging Symposium, Jun. 16-19, 1996, pp. 1-14.

Desbrandes, Robert, Wireline Formation Testing: A New Extended Drawdown Technique, Petroleum Engineer International, May 1991, pp. 40-44.

Moran, J.H. et al., Theoretical Analysis of Pressure Phenomena Associated with the Wireline Formation Tester, Aug. 1962, pp. 899-908.

Desbrandes, R. et al., A New Concept in Wireline Formation Testing: Extended Drawdown, CWLS Thirteenth Formation Evaluation Symposium, Calgary, Alberta, Canada, Sep. 11-13, 1991, pp. 1-25.

Stewart, George et al., Interpretation of the Pressure Response of the Repeat Formation Tester, Society of Petroleum Engineers Paper 8362.

* cited by examiner

FIG.4
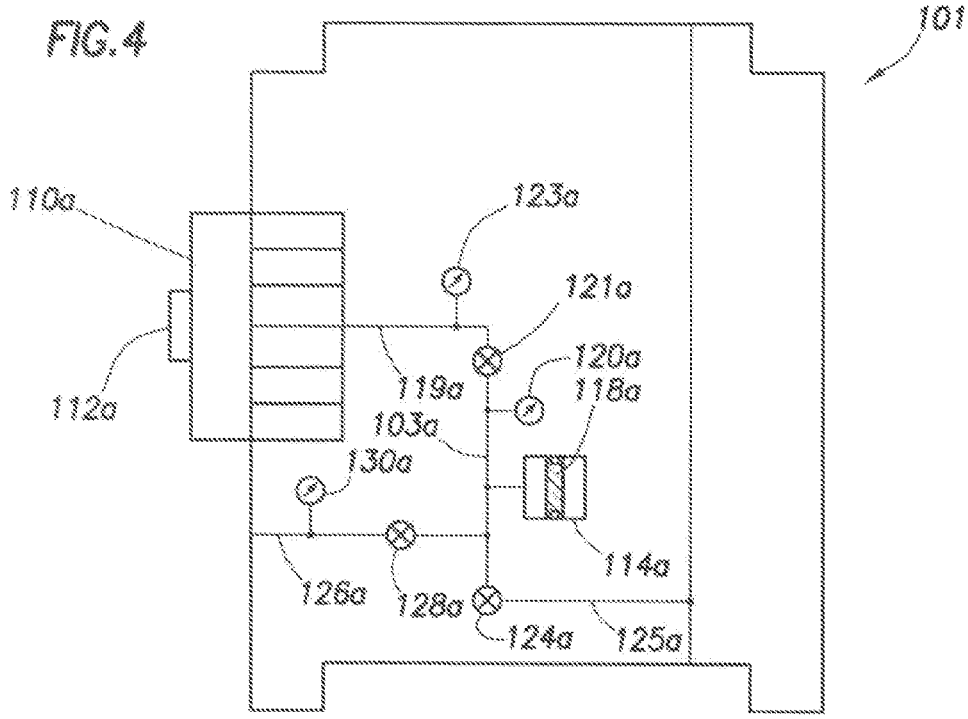
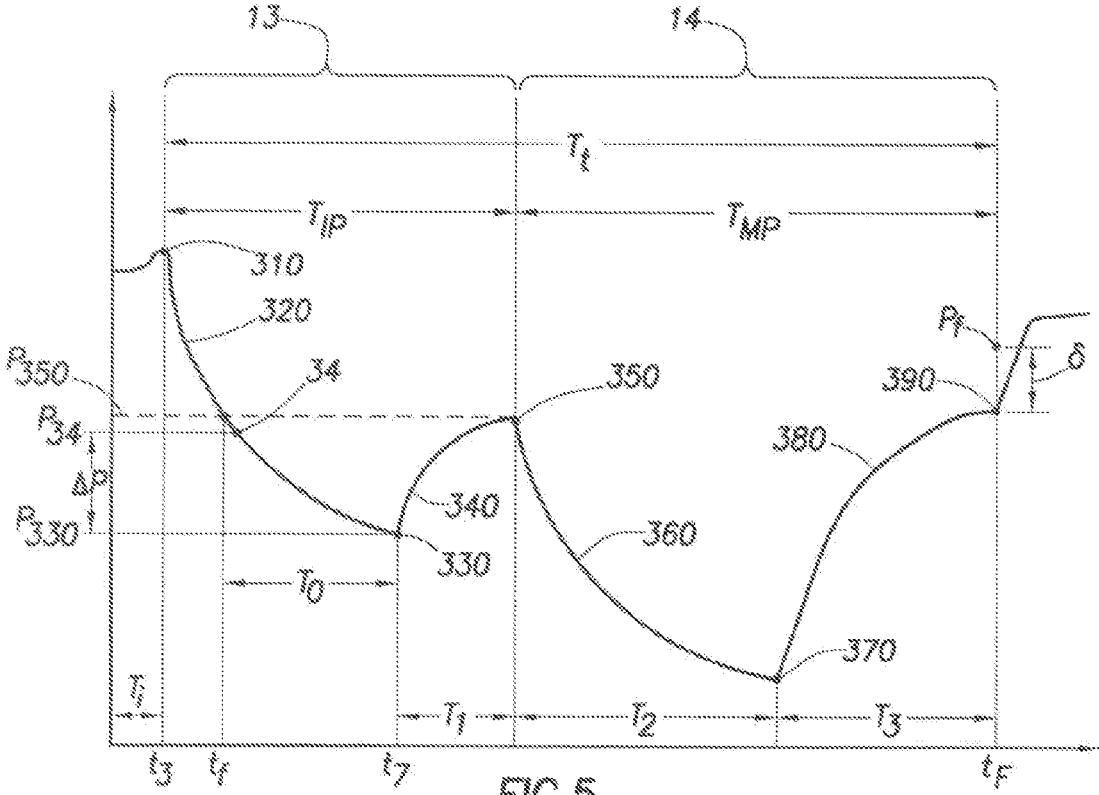
FIG.5

METHOD FOR MEASURING FORMATION PROPERTIES WITH A TIME-LIMITED FORMATION TEST

CROSS REFERENCE TO RELATED APPLICATION

This application is a division of U.S. patent application Ser. No. 10/237,394, filed on Sep. 9, 2002 now U.S. Pat. No. 6,832,515.

BACKGROUND OF INVENTION

1. Field of the Invention

The present invention relates generally to the field of oil and gas exploration. More particularly, the invention relates to methods for determining at least one property of a subsurface formation penetrated by a wellbore using a formation tester.

2. Background Art

Over the past several decades, highly sophisticated techniques have been developed for identifying and producing hydrocarbons, commonly referred to as oil and gas, from subsurface formations. These techniques facilitate the discovery, assessment, and production of hydrocarbons from subsurface formations.

When a subsurface formation containing an economically producible amount of hydrocarbons is believed to have been discovered, a borehole is typically drilled from the earth surface to the desired subsurface formation and tests are performed on the formation to determine whether the formation is likely to produce hydrocarbons of commercial value. Typically, tests performed on subsurface formations involve interrogating penetrated formations to determine whether hydrocarbons are actually present and to assess the amount of producible hydrocarbons therein. These preliminary tests are conducted using formation testing tools, often referred to as formation testers. Formation testers are typically lowered into a wellbore by a wireline cable, tubing, drill string, or the like, and may be used to determine various formation characteristics which assist in determining the quality, quantity, and conditions of the hydrocarbons or other fluids located therein. Other formation testers may form part of a drilling tool, such as a drill string, for the measurement of formation parameters during the drilling process.

Formation testers typically comprise slender tools adapted to be lowered into a borehole and positioned at a depth in the borehole adjacent to the subsurface formation for which data is desired. Once positioned in the borehole, these tools are placed in fluid communication with the formation to collect data from the formation. Typically, a probe, snorkel or other device is sealably engaged against the borehole wall to establish such fluid communication.

Formation testers are typically used to measure downhole parameters, such as wellbore pressures, formation pressures and formation mobilities, among others. They may also be used to collect samples from a formation so that the types of fluid contained in the formation and other fluid properties can be determined. The formation properties determined during a formation test are important factors in determining the commercial value of a well and the manner in which hydrocarbons may be recovered from the well.

The operation of formation testers may be more readily understood with reference to the structure of a conventional wireline formation tester shown in FIGS. 1A and 1B. As shown in FIG. 1A, the wireline tester 100 is lowered from an oil rig 2 into an open wellbore 3 filled with a fluid commonly referred to in the industry as "mud." The wellbore is lined with a mudcake 4 deposited onto the wall of the wellbore during drilling operations. The wellbore penetrates a formation 5.

The operation of a conventional modular wireline formation tester having multiple interconnected modules is described in more detail in U.S. Pat. Nos. 4,860,581 and 4,936,139 issued to Zimmerman et al. FIG. 2 depicts a graphical representation of a pressure trace over time measured by the formation tester during a conventional wireline formation testing operation used to determine parameters, such as formation pressure.

Referring now to FIGS. 1A and 1B, in a conventional wireline formation testing operation, a formation tester 100 is lowered into a wellbore 3 by a wireline cable 6. After lowering the formation tester 100 to the desired position in the wellbore, pressure in the flowline 119 in the formation tester may be equalized to the hydrostatic pressure of the fluid in the wellbore by opening an equalization valve (not shown). A pressure sensor or gauge 120 is used to measure the hydrostatic pressure of the fluid in the wellbore. The measured pressure at this point is graphically depicted along line 103 in FIG. 2. The formation tester 100 may then be "set" by anchoring the tester in place with hydraulically actuated pistons, positioning the probe 112 against the sidewall of the wellbore to establish fluid communication with the formation, and closing the equalization valve to isolate the interior of the tool from the well fluids. The point at which a seal is made between the probe and the formation and fluid communication is established, referred to as the "tool set" point, is graphically depicted at 105 in FIG. 2. Fluid from the formation 5 is then drawn into the formation tester 100 by retracting a piston 118 in a pretest chamber 114 to create a pressure drop in the flowline 119 below the formation pressure. This volume expansion cycle, referred to as a "drawdown" cycle, is graphically illustrated along line 107 in FIG. 2.

When the piston 118 stops retracting (depicted at point 111 in FIG. 2), fluid from the formation continues to enter the probe 112 until, given a sufficient time, the pressure in the flowline 119 is the same as the pressure in the formation 5, depicted at 115 in FIG. 2. This cycle, referred to as a "build-up" cycle, is depicted along line 113 in FIG. 2. As illustrated in FIG. 2, the final build-up pressure at 115, frequently referred to as the "sandface" pressure, is usually assumed to be a good approximation to the formation pressure.

The shape of the curve and corresponding data generated by the pressure trace may be used to determine various formation characteristics. For example, pressures measured during drawdown (107 in FIG. 2) and build-up (113 in FIG. 2) may be used to determine formation mobility, that is the ratio of the formation permeability to the formation fluid viscosity. When the formation tester probe 112 is disengaged from the wellbore wall, the pressure in flowline 119 increases rapidly as the pressure in the flowline equilibrates with the wellbore pressure, shown as line 117 in FIG. 2. After the formation measurement cycle has been completed, the formation tester 100 may be disengaged and repositioned at a different depth and the formation test cycle repeated as desired.

During this type of test operation for a wireline-conveyed tool, pressure data collected downhole is typically communicated to the surface electronically via the wireline communication system. At the surface, an operator typically monitors the pressure in flowline 119 at a console and the wireline logging system records the pressure data in real time. Data recorded during the drawdown and buildup cycles of the test may be analyzed either at the well site computer in real time or later at a data processing center to determine crucial formation parameters, such as formation fluid pressure, the mud overbalance pressure, ie the difference between the wellbore pressure and the formation pressure, and the mobility of the formation.

Wireline formation testers allow high data rate communications for real-time monitoring and control of the test and tool through the use of wireline telemetry. This type of communication system enables field engineers to evaluate the quality of test measurements as they occur, and, if necessary, to take immediate actions to abort a test procedure and/or adjust the pretest parameters before attempting another measurement. For example, by observing the data as they are collected during the pretest drawdown, an engineer may have the option to change the initial pretest parameters, such as drawdown rate and drawdown volume, to better match them to the formation characteristics before attempting another test. Examples of prior art wireline formation testers and/or formation test methods are described, for example, in U.S. Pat. No. 3,934,468 issued to Brieger; U.S. Pat. Nos. 4,860,581 and 4,936,139 issued to Zimmerman et al.; and U.S. Pat. No. 5,969,241 issued to Auzerais. These patents are assigned to the assignee of the present invention.

Formation testers may also be used during drilling operations. For example, one such downhole tool adapted for collecting data from a subsurface formation during drilling operations is disclosed in U.S. Pat. No. 6,230,557 B1 issued to Ciglenec et al., which is assigned to the assignee of the present invention.

Various techniques have been developed for performing specialized formation testing operations, or pretests. For example, U.S. Pat. Nos. 5,095,745 and 5,233,866 both issued to DesBrandes describe a method for determining formation parameters by analyzing the point at which the pressure deviates from a linear draw down.

Despite the advances made in developing methods for performing pretests, there remains a need to eliminate delays and errors in the pretest process, and to improve the accuracy of the parameters derived from such tests. Because formation testing operations are used throughout drilling operations, the duration of the test and the absence of real-time communication with the tools are major constraints that must be considered. The problems associated with real-time communication for these operations are largely due to the current limitations of the telemetry typically used during drilling operations, such as mud-pulse telemetry. Limitations, such as uplink and downlink telemetry data rates for most logging while drilling or measurement while drilling tools, result in slow exchanges of information between the downhole tool and the surface. For example, a simple process of sending a pretest pressure trace to the surface, followed by an engineer sending a command downhole to retract the probe based on the data transmitted may result in substantial delays which tend to adversely impact drilling operations.

Delays also increase the possibility of tools becoming stuck in the wellbore. To reduce the possibility of sticking, drilling operation specifications based on prevailing formation and drilling conditions are often established to dictate how long a drill string may be immobilized in a given borehole. Under these specifications, the drill string may only be allowed to be immobile for a limited period of time to deploy a probe and perform a pressure measurement. Due to the limitations of the current real-time communications link between some tools and the surface, it may be desirable that the tool be able to perform almost all operations in an automatic mode.

Therefore, a method is desired that enables a formation tester to be used to perform formation test measurements downhole within a specified time period and that may be easily implemented using wireline or drilling tools resulting in minimal intervention from the surface system.

SUMMARY OF INVENTION

One aspect of the invention relates to a method for determining formation parameters using a downhole tool positioned in a wellbore adjacent a subterranean formation, comprising the steps of establishing fluid communication with the formation; performing a first pretest to determine an initial estimate of the formation parameters; designing pretest criteria for performing a second pretest based on the initial estimate of the formation parameters; and performing a second pretest according to the designed criteria whereby a refined estimate of the formation parameters are determined.

One aspect of the invention relates to methods for determining formation properties using a formation tester. A method for determining at least one formation fluid property using a formation tester in a formation penetrated by a borehole includes collecting a first set of data points representing pressures in a pretest chamber of the formation tester as a function of time during a first pretest; determining an estimated formation pressure and an estimated formation fluid mobility from the first set of data points; determining a set of parameters for a second pretest, the set of parameters being determined based on the estimated formation pressure, the estimated formation fluid mobility, and a time remaining for performing the second pretest; performing the second pretest using the set of parameters; collecting a second set of data points representing pressures in the pretest chamber as a function of time during the second pretest; and determining the at least one formation fluid property from the second set of data points.

Another aspect of the invention relates to methods for determining a condition for terminating a drawdown operation during a pretest. A method for determining a termination condition for a drawdown operation using a formation tester in a formation penetrated by a borehole includes setting a probe of the formation tester against a wall of the borehole so that a pretest chamber is in fluid communication with the formation, a drilling fluid in the pretest chamber having a higher pressure than the formation pressure; decompressing the drilling fluid in the pretest chamber by withdrawing a pretest piston at a constant drawdown rate; collecting data points representing fluid pressures in the pretest chamber as a function of time; identifying a range of consecutive data points that fit a line of pressure versus time with a fixed slope, the fixed slope being based on a compressibility of the drilling fluid, the constant drawdown rate, and a volume of the pretest chamber; and terminating the drawdown operation based on a termination criterion after the range of the consecutive data points is identified.

Another aspect of the invention relates to methods for determining formation fluid mobilities. A method for estimating a formation fluid mobility includes performing a pretest using a formation tester disposed in a formation penetrated by a borehole, the pretest comprising a drawdown phase and a buildup phase; collecting data points representing pressures in a pretest chamber of the formation tester as a function of time during the drawdown phase and the buildup phase; determining an estimated formation pressure from the data points; determining an area bounded by a line passing through the estimated formation pressure and curves interpolating the data points during the drawdown phase and the buildup phase; and estimating the formation fluid mobility from the area, a volume extracted from the formation during the pretest, a radius of the formation testing probe, and a shape factor that accounts for the effect of the borehole on a response of the formation testing probe.

Another aspect of the invention relates to methods for estimating formation pressures from drawdown operations during pretests. A method for determining an estimated formation pressure from a drawdown operation using a formation tester in a formation penetrated by a borehole includes setting the formation tester against a wall of the borehole so that a pretest chamber of the formation tester is in fluid communication with the formation, a drilling fluid in the pretest chamber having a higher pressure than the formation pressure; decompressing the drilling fluid in the pretest chamber by withdrawing a pretest piston in the formation tester at a constant drawdown rate; collecting data points representing fluid pressures in the pretest chamber as a function of time; identifying a range of consecutive data points that fit a line of pressure versus time with a fixed slope, the fixed slope being based on a compressibility of the drilling fluid, the constant drawdown rate, and a volume of the pretest chamber; and determining the estimated formation pressure from a first data point after the range of the consecutive data points.

Other aspects and advantages of the invention will be apparent from the following description and the appended claims.

BRIEF DESCRIPTION OF DRAWINGS

FIG. 4 shows a schematic of components of a module of a formation tester suitable for practicing embodiments of the invention.

FIG. 5 shows a graphical representation of a pressure measurements versus time plot for performing the pretest of FIG. 3.

FIG. 16A shows a mud filtration phase. FIG. 16B shows a modified mud filtration phase with a repeat compression cycle. FIG. 16C shows a modified mud filtration phase with a decompression cycle.

DETAILED DESCRIPTION

Figure 3:
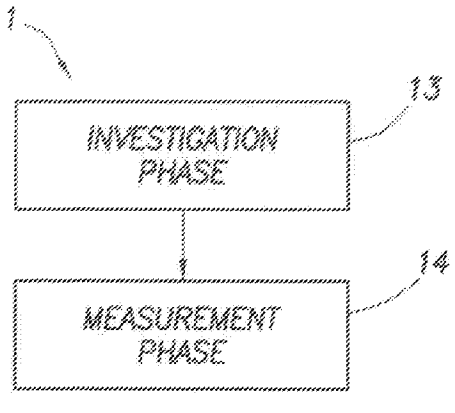
FIG. 3 shows a flow chart of steps involved in a pretest according to an embodiment of the invention.

An embodiment of the present invention relating to a method 1 for estimating formation properties (e.g. formation pressures and mobilities) is shown in the block diagram of FIG. 3. As shown in FIG. 3, the method includes an investigation phase 13 and a measurement phase 14.

Figure 1A:
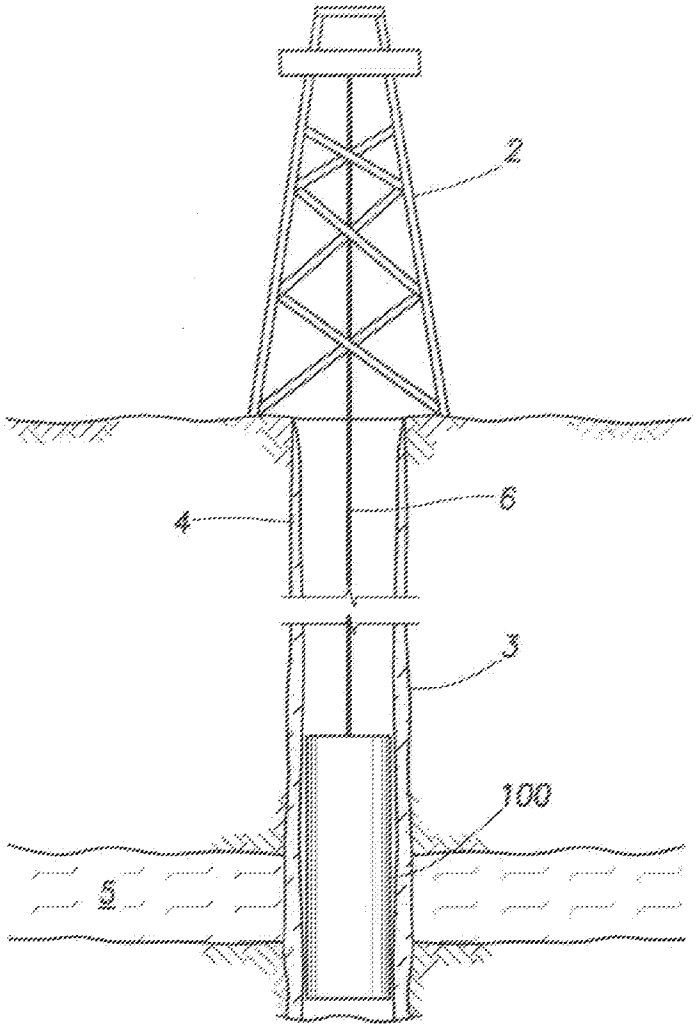
FIG. 1A (PRIOR ART)
FIG. 1A shows a conventional wireline formation tester disposed in a wellbore.
Figure 1B:
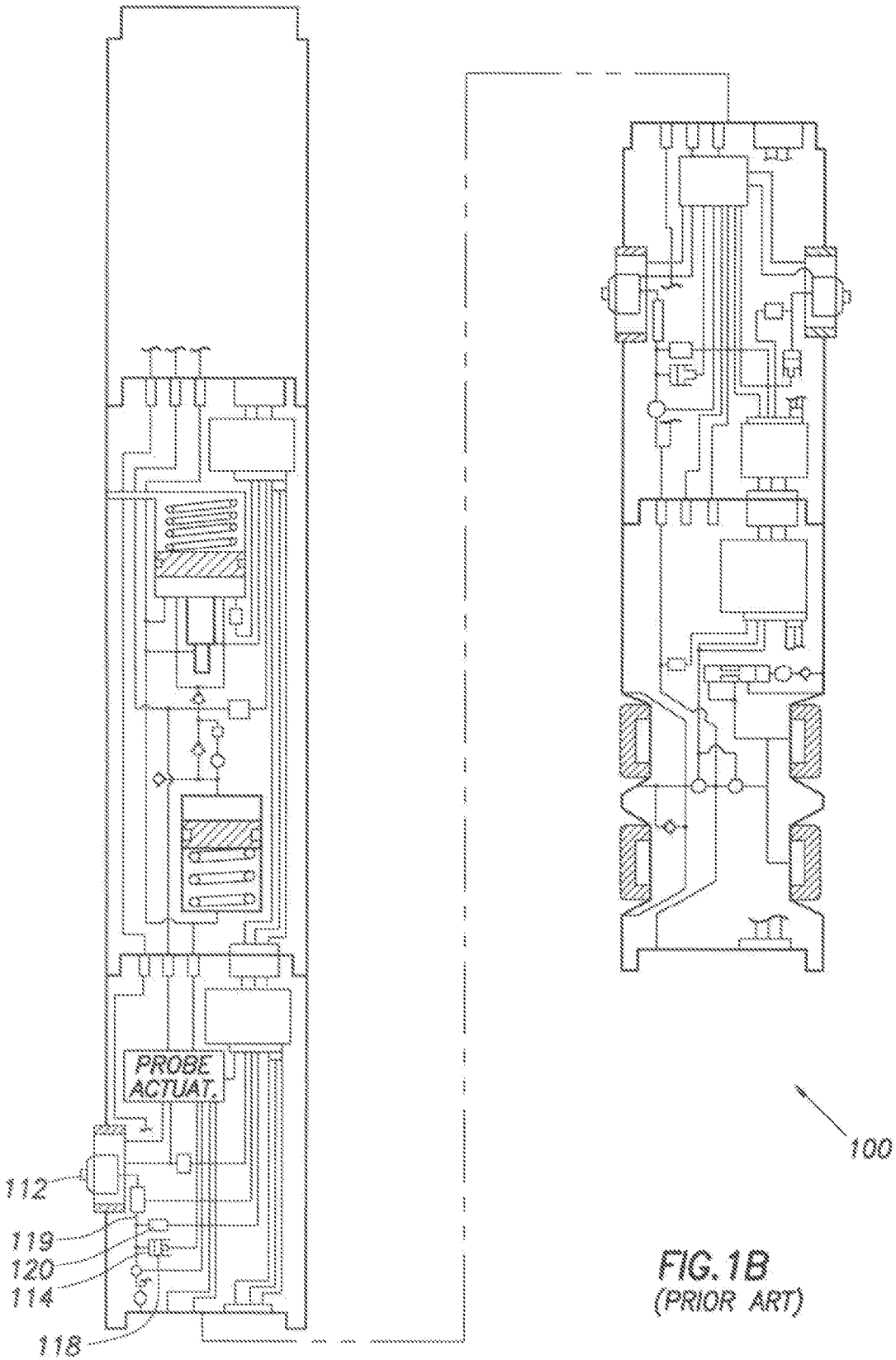
FIG. 1B (PRIOR ART)
FIG. 1B shows a cross sectional view of the modular conventional wireline formation tester of FIG. 1A.

The method may be practiced with any formation tester known in the art, such as the tester described with respect to FIGS. 1A and 1B. Other formation testers may also be used and/or adapted for embodiments of the invention, such as the wireline formation tester of U.S. Pat. Nos. 4,860,581 and 4,936,139 issued to Zimmerman et al. and the downhole drilling tool of U.S. Pat. No. 6,230,557 B1 issued to Ciglenec et al. the entire contents of which are hereby incorporated by reference.

A version of a probe module usable with such formation testers is depicted in FIG. 4. The module 101 includes a probe 112*a*, a packer 110*a* surrounding the probe, and a flow line 119*a* extending from the probe into the module. The flow line 119*a* extends from the probe 112*a* to probe isolation valve 121*a*, and has a pressure gauge 123*a*. A second flow line 103*a* extends from the probe isolation valve 121*a* to sample line isolation valve 124*a* and equalization valve 128*a*, and has pressure gauge 120*a*. A reversible pretest piston 118*a* in a pretest chamber 114*a* also extends from flow line 103*a*. Exit line 126*a* extends from equalization valve 128*a* and out to the wellbore and has a pressure gauge 130*a*. Sample flow line 125*a* extends from sample line isolation valve 124*a* and through the tool. Fluid sampled in flow line 125*a* may be captured, flushed, or used for other purposes.

Probe isolation valve 121*a* isolates fluid in flow line 119*a* from fluid in flow line 103*a*. Sample line isolation valve 124*a*, isolates fluid in flow line 103*a* from fluid in sample line 125*a*. Equalizing valve 128*a* isolates fluid in the wellbore from fluid in the tool. By manipulating the valves to selectively isolate fluid in the flow lines, the pressure gauges 120*a* and 123*a* may be used to determine various pressures. For example, by closing valve 121*a* formation pressure may be read by gauge 123*a* when the probe is in fluid communication with the formation while minimizing the tool volume connected to the formation.

In another example, with equalizing valve 128*a* open mud may be withdrawn from the wellbore into the tool by means of pretest piston 118*a*. On closing equalizing valve 128*a*, probe isolation valve 121*a* and sample line isolation valve 124*a* fluid may be trapped within the tool between these valves and the pretest piston 118*a*. Pressure gauge 130*a* may be used to monitor the wellbore fluid pressure continuously throughout the operation of the tool and together with pressure gauges 120*a* and 123*a* may be used to measure directly the pressure drop across the mudcake and to monitor the transmission of wellbore disturbances across the mudcake for later use in correcting the measured sandface pressure for these disturbances.

Among the functions of pretest piston 118*a* is to withdraw fluid from or inject fluid into the formation or to compress or expand fluid trapped between probe isolation valve 121*a*, sample line isolation valve 124*a* and equalizing valve 128*a*. The pretest piston 118*a* preferably has the capability of being operated at low rates, for example 0.01 $cm^3$/sec, and high rates, for example 10 $cm^3$/sec, and has the capability of being able to withdraw large volumes in a single stroke, for example 100 $cm^3$. In addition, if it is necessary to extract more than 100 $cm^3$ from the formation without retracting the probe, the pretest piston 118*a* may be recycled. The position of the pretest piston 118*a* preferably can be continuously monitored and positively controlled and its position can be "locked" when it is at rest. In some embodiments, the probe 112*a* may further include a filter valve (not shown) and a filter piston (not shown).

Various manipulations of the valves, pretest piston and probe allow operation of the tool according to the described methods. One skilled in the art would appreciate that, while these specifications define a preferred probe module, other specifications may be used without departing from the scope of the invention. While FIG. 4 depicts a probe type module, it will be appreciated that either a probe tool or a packer tool may be used, perhaps with some modifications. The following description assumes a probe tool is used. However, one skilled in the art would appreciate that similar procedures may be used with packer tools.

As shown in FIG. 5, the investigation phase 13 relates to obtaining initial estimates of formation parameters, such as formation pressure and formation mobility. These initial estimates may then be used to design the measurement phase. If desired and allowed, a measurement phase is then performed according to these parameters to generate a refined estimate of the formation parameters. FIG. 5 depicts a corresponding pressure trace illustrating the changes in pressure over time as the method of FIG. 3 is performed. It will be appreciated that, while the pressure trace of FIG. 5 may be performed by the apparatus of FIG. 4, it may also be performed by other downhole tools, such as the tester of FIGS. 1A and 1B.

Figure 2:
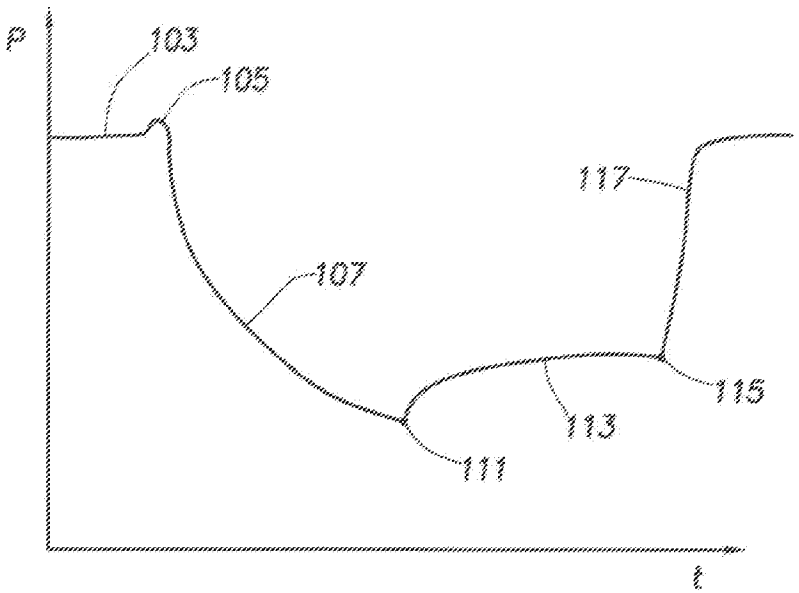
FIG. 2 (PRIOR ART)
FIG. 2 shows a graphical representation of pressure measurements versus time plot for a typical prior art pretest sequence performed using a conventional formation tester.
Figure 6:
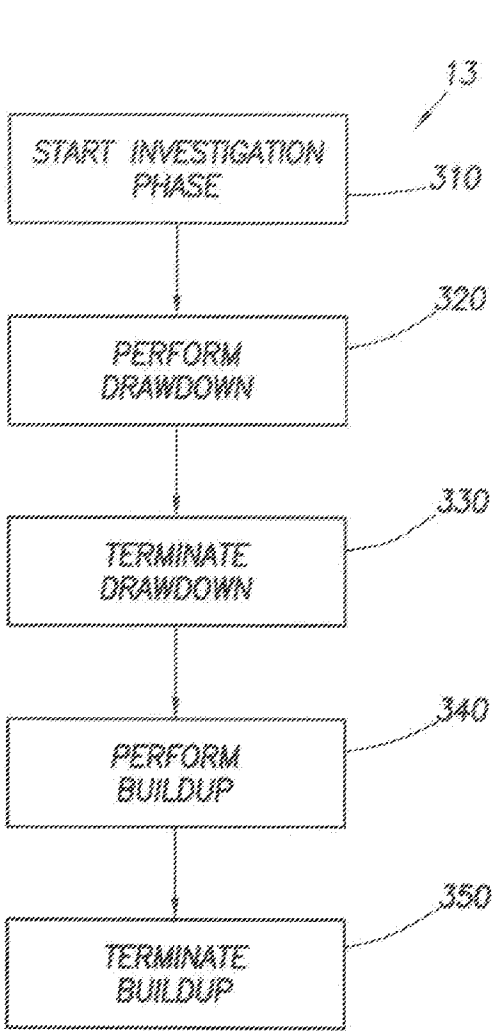
FIG. 6 shows a flow chart detailing the steps involved in performing the investigation phase of the flow chart of FIG. 3.

The investigation phase 13 is shown in greater detail in FIG. 6. The investigation phase comprises initiating the drawdown 310 at time $t_3$ after the tool is set during time $T_i$, performing the drawdown 320, terminating the drawdown 330, performing the buildup 340 and terminating the buildup 350. To start the investigation phase according to step 310, the probe 112*a* is placed in fluid communication with the formation and anchored into place and the interior of the tool is isolated from the wellbore. The drawdown 320 is performed by advancing the piston 118*a* in pretest chamber 114*a*. To terminate drawdown 330, the piston 118*a* is stopped. The pressure will begin to build up in flow line 119*a* until the buildup 340 is terminated at 350. The investigation phase lasts for a duration of time $T_{IP}$. The investigation phase may also be performed as previously described with respect to FIGS. 1B and 2, the drawdown flow rate and the drawdown termination point being pre-defined before the initiation of the investigation phase.

Figure 7:
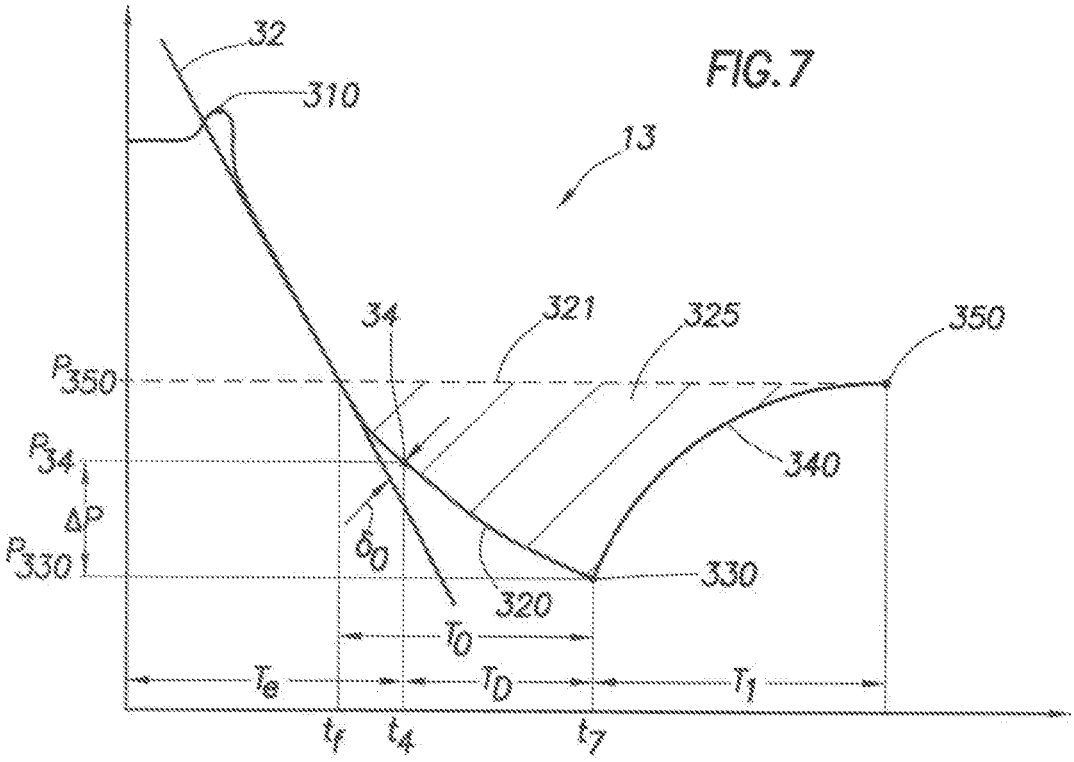
FIG. 7 shows a detailed view of the investigation phase portion of the plot of FIG. 5 depicting the termination of drawdown.

The pressure trace of the investigation phase 13 is shown in greater detail in FIG. 7. Parameters, such as formation pressure and formation mobility, may be determined from an analysis of the data derived from the pressure trace of the investigation phase. For example, termination point 350 represents a provisional estimate of the formation pressure. Alternatively, formation pressures may be estimated more precisely by extrapolating the pressure trend obtained during build up 340 using techniques known by those of skill in the art, the extrapolated pressure corresponding to the pressure that would have been obtained had the buildup been allowed to continue indefinitely. Such procedures may require additional processing to arrive at formation pressure.

Formation mobility $(K/\mu)_1$ may also be determined from the build up phase represented by line 340. Techniques known by those of skill in the art may be used to estimate the formation mobility from the rate of pressure change with time during build up 340. Such procedures may require additional processing to arrive at estimates of the formation mobility.

Alternatively, the work presented in a publication by Goode et al. entitled "Multiple Probe Formation Testing and Vertical Reservoir Continuity", SPE 22738, prepared for presentation at the 1991 Society of Petroleum Engineers Annual Technical Conference and Exhibition, held at Dallas, Tex. on Oct. 6 through 9, 1991 implies that the area of the graph depicted by the shaded region and identified by reference numeral 325, denoted herein by A, may be used to predict formation mobility. This area is bounded by a line 321 extending horizontally from termination point 350 (representing the estimated formation pressure $P_{350}$ at termination), the drawdown line 320 and the build up line 340. This area may be determined and related to an estimate of the formation mobility through use of the following equation:

$$\left(\frac{K}{\mu}\right)_1 = \frac{V_1}{4r_p}\frac{\Omega_S}{A} + \varepsilon_K \tag{1}$$

where $(K/\mu)_1$ is the first estimate of the formation mobility (D/cP), where K is the formation permeability (Darcies, denoted by D) and $\mu$ is the formation fluid viscosity (cP) (since the quantity determined by formation testers is the ratio of the formation permeability to the formation fluid viscosity, ie the mobility, the explicit value of the viscosity is not needed); $V_1$ ($cm^3$) is the volume extracted from the formation during the investigation pretest, $V_1=V(t_7+T_1)-V(t_7-T_0)=V(t_7)-V(t_7-T_0)$ where V is the volume of the pretest chamber; $r_p$ is the probe radius (cm); and $\epsilon_K$ is an error term which is typically small (less than a few percent) for formations having a mobility greater than 1 mD/cP.

The variable $\Omega_S$, which accounts for the effect of a finite-size wellbore on the pressure response of the probe, may be determined by the following equation described in a publication by F. J. Kuchuk entitled "Multiprobe Wireline Formation Tester Pressure Behavior in Crossflow-Layered Reservoirs", In Situ, (1996) 20, 1,1:

$$\Omega_s=0.994-0.003\theta-0.353\theta^2-0.714\theta^3+0.709\theta^4 \tag{2}$$

where $r_p$ and $r_w$ represent the radius of the probe and the radius of the well, respectively; $\rho=r_p/r_w$, $\eta=K_r/K_z$; $\theta=0.58+$ 0.078 $\log\eta+0.26\log\rho+0.8\rho^2$; and $K_r$ and $K_z$ represent the radial permeability and the vertical permeability, respectively.

In stating the result presented in equation 1 it has been assumed that the formation permeability is isotropic, that is $K_r=K_z=K$, that the flow regime during the test is "spherical", and that the conditions which ensure the validity of Darcy's relation hold.

Referring still to FIG. 7, the drawdown step 320 of the investigation phase may be analyzed to determine the pressure drop over time to determine various characteristics of the pressure trace. A best fit line 32 derived from points along drawdown line 320 is depicted extending from initiation point 310. A deviation point 34 may be determined along curve 320 representing the point at which the curve 320 reaches a minimum deviation $\delta_0$ from the best fit line 32. The deviation point 34 may be used as an estimate of the "onset of flow", the point time $T_e$ at which fluid is delivered from the formation into the tool during the investigation phase drawdown.

The deviation point 34 may be determined by known techniques, such as the techniques disclosed in U.S. Pat. Nos. 5,095,745 and 5,233,866 both issued to Desbrandes, the entire contents of which are hereby incorporated by reference. Debrandes teaches a technique for estimating the formation pressure from the point of deviation from a best fit line created using datapoints from the drawdown phase of the pretest. The deviation point may alternatively be determined by testing the most recently acquired point to see if it remains on the linear trend representing the flowline expansion as successive pressure data are acquired. If not, the drawdown may be terminated and the pressure allowed to stabilize. The deviation point may also be determined by taking the derivative of the pressure recorded during 320 with respect to time. When the derivative changes (presumably becomes less) by 2–5%, the corresponding point is taken to represent the beginning of flow from the formation. If necessary, to confirm that the deviation from the expansion line represents flow from the formation, further small-volume pretests may be performed.

Other techniques may be used to determine deviation point 34. For example, another technique for determining the deviation point 34 is based on mud compressibility and will be discussed further with respect to FIGS. 9–11.

Once the deviation point 34 is determined, the drawdown is continued beyond the point 34 until some prescribed termination criterion is met. Such criteria may be based on pressure, volume and/or time. Once the criterion has been met, the drawdown is terminated and termination point 330 is reached. It is desirable that the termination point 330 occur at a given pressure $P_{330}$ within a given pressure range $\Delta P$ relative to the deviation pressure $P_{34}$ corresponding to deviation point 34 of FIG. 7. Alternatively, it may be desirable to terminate drawdown within a given period of time following the determination of the deviation point 34. For example, if deviation occurs at time $t_4$, termination may be preset to occur by time $t_7$, where the time expended between time $t_4$ and $t_7$ is designated as $T_D$ and is limited to a maximum duration. Another criterion for terminating the pretest is to limit the volume withdrawn from the formation after the point of deviation 34 has been identified. This volume may be determined by the change in volume of the pretest chamber 114*a* (FIG. 4). The maximum change in volume may be specified as a limiting parameter for the pretest.

One or more of the limiting criteria, pressure, time and/or volume, may be used alone or in combination to determine the termination point 330. If, for example, as in the case of highly permeable formations, a desired criterion, such as a predetermined pressure drop, cannot be met, the duration of the pretest may be further limited by one or more of the other criteria.

After deviation point 34 is reached, pressure continues to fall along line 320 until expansion terminates at point 330. At this point, the probe isolation valve 121*a* is closed and/or the pretest piston 118*a* is stopped and the investigation phase build up 340 commences. The build up of pressure in the flowline=continues until termination of the buildup occurs at point 350.

The pressure at which the build up becomes sufficiently stable is often taken as an estimate of the formation pressure. The buildup pressure is monitored to provide data for estimating the formation pressure from the progressive stabilization of the buildup pressure. In particular, the information obtained may be used in designing a measurement phase transient such that a direct measurement of the formation pressure is achieved at the end of build up. The question of how long the investigation phase buildup should be allowed to continue to obtain an initial estimate of the formation pressure remains.

It is clear from the previous discussion that the buildup should not be terminated before pressure has recovered to the level at which deviation from the flowline decompression was identified, ie the pressure designated by $P_{34}$ on FIG. 7. In one approach, a set time limit may be used for the duration of the buildup $T_1$. $T_1$ may be set at some number, such as 2 to 3 times the time of flow from the formation $T_0$. Other techniques and criteria may be envisioned.

As shown in FIGS. 5 and 7, termination point 350 depicts the end of the buildup, the end of the investigation phase and/or the beginning of the measurement phase. Certain criteria may be used to determine when termination 350 should occur. A possible approach to determination of termination 350 is to allow the measured pressure to stabilize. To establish a point at which a reasonably accurate estimate of formation pressure at termination point 350 may be made relatively quickly, a procedure for determining criteria for establishing when to terminate may be used.

Figure 8:
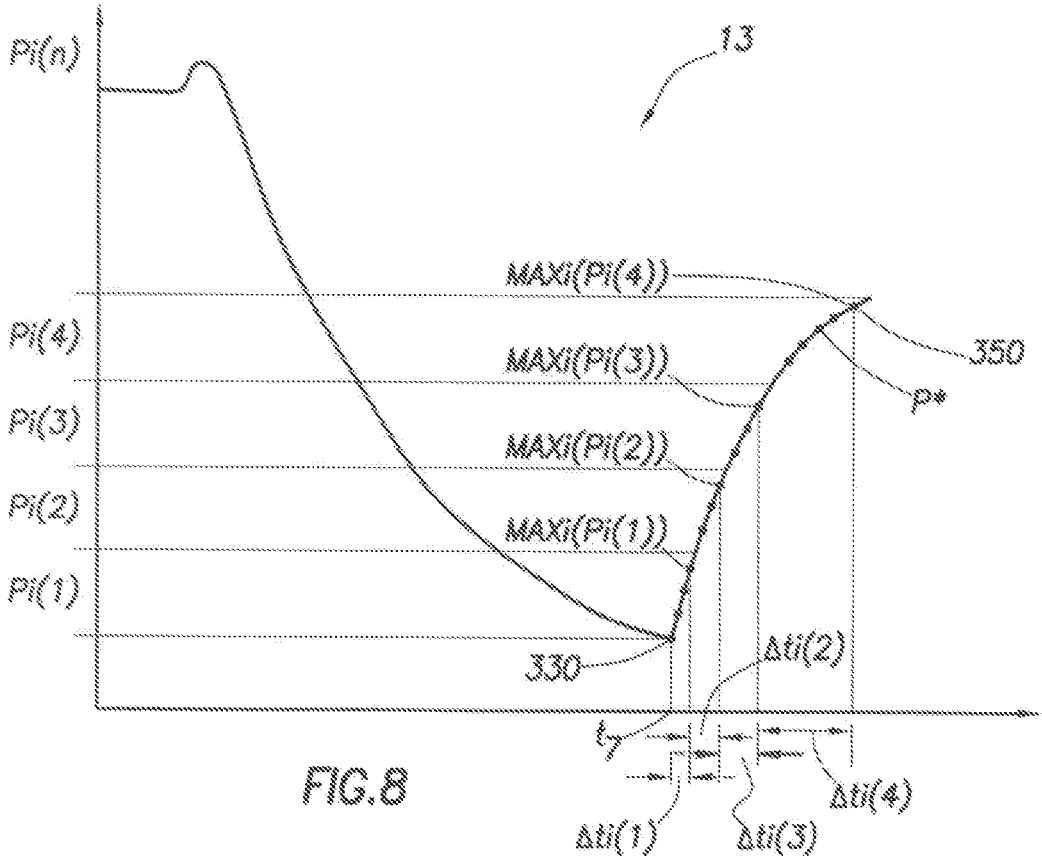
FIG. 8 shows a detailed view of the investigation phase portion of the plot of FIG. 5 depicting the determination of termination of buildup.

As shown in FIG. 8, one such procedure involves establishing a pressure increment beginning at the termination of drawdown point 330. For example, such a pressure increment could be a large multiple of the pressure gauge resolution, or a multiple of the pressure gauge noise. As buildup data are acquired successive pressure points will fall within one such interval. The highest pressure data point within each pressure increment is chosen and differences are constructed between the corresponding times to yield the time increments $\Delta t_{i(n)}$. Buildup is continued until the ratio of two successive time increments is greater than or equal to a predetermined number, such as 2. The last recorded pressure point in the last interval at the time this criterion is met is the calculated termination point 350. This analysis may be mathematically represented by the following:

Starting at $t_7$, the beginning of the buildup of the investigation phase, find a sequence of indices $\{i(n)\} \subset \{i\}$, $i(n) > i(n-1)$, $n=2,3, \ldots$, such that for $n \geqq 2, i(1)=1$, and $$\max_i (p_{i(n)} - p_{i(n-1)}) \leq \max(n_P \delta_P, \varepsilon_P) \tag{3}$$

where $n_p$ is a number with a value equal to or greater than 4, typically 10 or greater, $\delta_p$ is the nominal resolution of the pressure measuring instrument; and $\epsilon_p$ is a small multiple, say 2, of the pressure instrument noise—a quantity which may be determined prior to setting the tool, such as during the mud compressibility experiment.

One skilled in the art would appreciate that other values of $n_p$ and $\epsilon_p$ may be selected, depending on the desired results, without departing from the scope of the invention. If no points exist in the interval defined by the right hand side of equation (3) other than the base point take the closest point outside the interval.

Defining $\Delta t_{i(n)} \equiv t_{i(n)} - t_{i(n-1)}$, the buildup might be terminated when the following conditions are met: $p_{i(n)} \geqq p(t_4) = P_{34}$ (FIG. 8) and $$\frac{\Delta t_{i(n)}}{\Delta t_{i(n-1)}} \geq m_P \tag{4}$$

where $m_p$ is a number greater than or equal to 2.

The first estimate of the formation pressure is then defined as (FIG. 7):

$$p(t_{i(max(n))}) = p(t_7 + T_1) = P_{350} \tag{5}$$

In rough terms, the investigation phase pretest according to the current criterion is terminated when the pressure during buildup is greater than the pressure corresponding to the point of deviation 34 and the rate of increase in pressure decreases by a factor of at least 2. An approximation to the formation pressure is taken as the highest pressure measured during buildup.

The equations (3) and (4) together set the accuracy by which the formation pressure is determined during the investigation phase: equation (3) defines a lower bound on the error and $m_p$ roughly defines how close the estimated value is to the true formation pressure. The larger the value of $m_p$, the closer the estimated value of the formation pressure will be to the true value, and the longer the duration of the investigation phase will be.

As shown in FIG. 7, the termination point 350 depicts the end of the investigation phase 13 following completion of the build up phase 340. However, there may be instances where it is necessary or desirable to terminate the pretest. For example, problems in the process, such as when the probe is plugged, the test is dry or the formation mobility is so low that the test is essentially dry, the mud pressure exactly balances the formation pressure, a false breach, very low permeability formations, a change in the compressibility of gas or other issues, may justify termination of the pretest prior to completion of the entire cycle. Once it is desired that the pretest be terminated during the investigation phase, the pretest piston may be halted or probe isolation valve 121 closed (if present) so that the volume in flow line 119 is reduced to a minimum. Once a problem has been detected, the investigation phase may be terminated. If desired, a new investigative phase may be performed.

Referring back to FIG. 5, upon completion of the investigation phase 13, a decision must be made on whether the conditions permit or make desirable performance of the measurement phase 14. This decision may be performed manually. However, it is preferable that the decision be made automatically, and on the basis of set criteria.

One criterion that may be used is simply time. It may be necessary to determine whether there is sufficient time $T_{MP}$ to perform the measurement phase. In FIG. 5, there was sufficient time to perform both an investigation phase and a measurement phase. In other words, the total time $T_t$ to perform both phases was less than the time allotted for the cycle. Typically, when $T_{IP}$ is less than half the total time $T_t$, there is sufficient time to perform the measurement phase.

Another criterion that may be used to determine whether to proceed with the measurement phase is volume V. It may also be necessary or desirable, for example, to determine whether the volume of the measurement phase will be at least as great as the volume extracted from the formation during the investigation phase. If one or more of conditions are not met, the measurement phase may not be executed. Other criteria may also be determinative of whether a measurement phase should be performed. Alternatively, despite the failure to meet any criteria, the investigation phase may be continued through the remainder of the allotted time to the end so that it becomes, by default, both the investigation phase and the measurement phase.

It will be appreciated that while FIG. 5 depicts a single investigation phase 13 in sequence with a single measurement phase 14, various numbers of investigation phases and measurement phases may be performed in accordance with the present invention. Under extreme circumstances, the investigation phase estimates may be the only estimates obtainable because the pressure increase during the investigation phase buildup may be so slow that the entire time allocated for the test is consumed by this investigation phase. This is typically the case for formations with very low permeabilities. In other situations, such as with moderately to highly permeable formations where the buildup to formation pressure will be relatively quick, it may be possible to perform multiple pretests without running up against the allocated time constraint.

Referring still to FIG. 5, once the decision is made to perform the measurement phase 14, then the parameters of the investigation phase 13 are used to design the measurement phase. The parameters derived from the investigation phase, namely the formation pressure and mobility, are used in specifying the operating parameters of the measurement phase pretest. In particular, it is desirable to use the investigation phase parameters to solve for the volume of the measurement phase pretest and its duration and, consequently, the corresponding flow rate. Preferably, the measurement phase operating parameters are determined in such a way to optimize the volume used during the measurement phase pretest resulting in an estimate of the formation pressure within a given range. More particularly, it is desirable to extract just enough volume, preferably a larger volume than the volume extracted from the formation during the investigation phase, so that at the end of the measurement phase, the pressure recovers to within a desired range $\delta$ of the true formation pressure $p_f$. The volume extracted during the measurement phase is preferably selected so that the time constraints may also be met.

Let H represent the pressure response of the formation to a unit step in flow rate induced by a probe tool as previously described. The condition that the measured pressure be within $\delta$ of the true formation pressure at the end of the measurement phase can be expressed as:

$$H(T'_{tD}) - H((T'_t - T_o)_D) + \frac{q_2}{q_1} \tag{6}$$

$$\{H((T'_t - T_o - T_1)_D) - H((T'_t - T_o - T_1 - T_2)_D)\} \leq \frac{2\pi r_w \sqrt{K_r K_z}}{\mu q_1}\delta$$

where $T_t'$ is the total time allocated for both the investigation and measurement phases minus the time taken for flowline expansion, ie $T_t'=T_t-(t_f-t_3)=T_0+T_1+T_2+T_3$ in FIG. 5 (prescribed before the test is performed—seconds); $T_o$ is the approximate duration of formation flow during the investigation phase (determined during acquisition—seconds); $T_1$ is the duration of the buildup during the investigation phase (determined during acquisition—seconds); $T_2$ is the duration of the drawdown during the measurement phase (determined during acquisition—seconds); $T_3$ is the duration of the buildup during the measurement phase (determined during acquisition—seconds); $q_1$ and $q_2$ represent, respectively, the constant flowrates of the investigation and measurement phases respectively (specified before acquisition and determined during acquisition—$cm^3$/sec); $\delta$ is the accuracy to which the formation pressure is to be determined during the measurement phase (prescribed—atmospheres), ie, $p_f-p(T_t)\leqq\delta$, where $p_f$ is the true formation pressure; $\phi$ is the formation porosity, $C_t$ is the formation total compressibility (prescribed before acquisition from knowledge of the formation type and porosity through standard correlations—1/atmospheres);

$$T_{nD}=\frac{K_rT_n}{\phi\mu C_tr_*^2}\equiv\frac{T_n}{\tau}$$

where n=t, 0, 1, 2 denotes a dimensionless time and $\tau\equiv\phi\mu C_tr^{*2}/K_r$ represents a time constant; and, $r^*$ is an effective probe radius defined by $$r_*=\frac{r_p}{K(m;\pi/2)}\frac{1}{\Omega_S}=\frac{2r_p}{\pi(1+(1/2)^2m+(3/8)^2m^2+O(m^3))}\frac{1}{\Omega_S}$$

where K is a complete elliptic integral of the first kind with modulus $m\equiv\sqrt{1-K_z/K_r}$. If the formation is isotopic then $r^*=2r_p/(\pi\Omega_S)$.

Equivalently, the measurement phase may be restricted by specifying the ratio of the second to the first pretest flow rates and the duration, $T_2$, of the measurement phase pretest, and therefore its volume.

In order to completely specify the measurement phase, it may be desirable to further restrict the measurement phase based on an additional condition. One such condition may be based on specifying the ratio of the duration of the drawdown portion of the measurement phase relative to the total time available for completion of the entire measurement phase since the duration of the measurement phase is known after completion of the investigation phase, namely, $T_2+T_3=T_t'-T_o-T_1$. For example, one may wish to allow twice (or more than twice) as much time for the buildup of the measurement phase as for the drawdown, then $T_3=n_TT_2$, or, $T_2=(T_t'-T_o-T_1)/(n_T+1)$ where $n_T\geqq22$. Equation (6) may then be solved for the ratio of the measurement to investigation phase pretest flowrates and consequently the volume of the measurement phase $V_2=q_2T_2$.

Yet another condition to complete the specification of the measurement phase pretest parameters would be to limit the pressure drop during the measurement phase drawdown. With the same notation as used in equation (6) and the same governing assumptions this condition can be written as $$H((T_o+T_1+T_2)_D)-H((T_1+T_2)_D)+\frac{q_2}{q_1}H((T_2)_D)\leq\frac{2\pi r_*\sqrt{K_rK_z}}{\mu q_1}\Delta p_{\max}\tag{7}$$

where $\Delta P_{max}$ (in atmospheres) is the maximum allowable drawdown pressure drop during the measurement phase.

The application of equations (6) and (7) to the determination of the measurement phase pretest parameters is best illustrated with a specific, simple but non-trivial case. For the purposes of illustration it is assumed that, as before, both the investigation and measurement phase pretests are conducted at precisely controlled rates. In addition it is assumed that the effects of tool storage on the pressure response may be neglected, that the flow regimes in both drawdown and buildup are spherical, that the formation permeability is isotropic and that the conditions ensuring the validity of Darcy's relation are satisfied.

Under the above assumptions equation (6) takes the following form:

$$\operatorname{erfc}\left(\frac{1}{2}\sqrt{\frac{\phi\mu C_tr_*^2}{KT_t'}}\right)-\operatorname{erfc}\left(\frac{1}{2}\sqrt{\frac{\phi\mu C_tr_*^2}{K(T_t'-T_o)}}\right)+\frac{q_2}{q_1}\left\{\operatorname{erfc}\left(\frac{1}{2}\sqrt{\frac{\phi\mu C_tr_*^2}{K(T_t'-T_o-T_1)}}\right)-\operatorname{erfc}\left(\frac{1}{2}\sqrt{\frac{\phi\mu C_tr_*^2}{K(T_t'-T_o-T_1-T_2)}}\right)\right\}\leq\frac{2\pi Kr_*}{\mu q_1}\delta\tag{8}$$

where erfc is the complementary error function.

Because the arguments of the error function are generally small, there is typically little loss in accuracy in using the usual square root approximation. After some rearrangement of terms equation (8) can be shown to take the form $$q_2\left(\sqrt{\lambda/(\lambda-T_2)}-1\right)\leq\frac{2\pi^{3/2}Kr_*}{\mu}\delta\sqrt{\frac{\lambda}{\tau}}-q_1\left(\sqrt{\lambda/(T_t'-T_o)}-\sqrt{\lambda/T_t'}\right)\equiv\frac{2\pi^{3/2}Kr_*}{\mu}\delta\sqrt{\frac{\lambda}{\tau}}-q_1u(\lambda)\tag{9}$$

where $\lambda\equiv T_2+T_3$, the duration of the measurement phase, is a known quantity once the investigation phase pretest has been completed.

The utility of this relation is clear once the expression in the parentheses on the left hand side is approximated further to obtain an expression for the desired volume of the measurement phase pretest.

$$V_2\left\{1+\left(\frac{3}{4}\right)\left(\frac{T_2}{\lambda}\right)+O(T_2^2)\right\}=4\pi^{3/2}\phi C_t\delta\left(\frac{K}{\mu}\frac{T_2+T_3}{\phi C_t}\right)^{3/2}-\lambda q_1u(\lambda)\tag{10}$$

With the same assumptions made in arriving at equation (8) from equation (6), equation (7) may be written as, $$\operatorname{erfc}\left(\frac{1}{2}\sqrt{\frac{\phi\mu C_t r*^2}{K(T_0+T_1+T_2)}}\right)-\operatorname{erfc}\left(\frac{1}{2}\sqrt{\frac{\phi\mu C_t r*^2}{K(T_1+T_2)}}\right)+\frac{q_2}{q_1}\operatorname{erfc}\left(\frac{1}{2}\sqrt{\frac{\phi\mu C_t r*^2}{KT_2}}\right)\leq\frac{2\pi Kr*}{\mu q_1}\Delta p_{\max} \tag{11}$$

which, after applying the square-root approximation for the complementary error function and rearranging terms, can be expressed as:

$$q_2\left(1-\sqrt{\tau/(\pi T_2)}\right)\leq\frac{2\pi Kr*}{\mu}\Delta p_{\max}-\frac{q_1}{\sqrt{\pi}}\left(\sqrt{\tau/(T_1+T_2)}-\sqrt{\tau/(T_0+T_1+T_2)}\right)\equiv\frac{2\pi Kr*}{\mu}\Delta p_{\max}-q_1\nu(T_2) \tag{12}$$

Combining equations (9) and (12) gives rise to:

$$\sqrt{\frac{\lambda}{\lambda-T_2}}=1+\left\{\sqrt{\pi}\frac{\delta}{\Delta p_{\max}}\sqrt{\frac{\lambda}{\tau}}-\frac{q_1\mu}{2\pi Kr*}\frac{1}{\Delta p_{\max}}u(\lambda)\right\}\times\left\{1+\frac{q_1\mu}{2\pi Kr*\Delta p_{\max}}\nu(T_2)\right\}^{-1}\left(1-\sqrt{\tau/(\pi T_2)}\right)^{-1} \tag{13}$$

Because the terms in the last two bracket/parenthesis expressions are each very close to unity, equation (13) may be approximated as:

$$\frac{T_2}{\lambda}\approx 1-\left\{1+\sqrt{\pi}\frac{\delta}{\Delta p_{\max}}\sqrt{\frac{\lambda}{\tau}}-\frac{q_1\mu}{2\pi Kr*\Delta p_{\max}}u(\lambda)\right\}^{-2} \tag{14}$$

which gives an expression for the determination of the duration of the measurement phase drawdown and therefore, in combination with the above result for the measurement phase pretest volume, the value of the measurement phase pretest flowrate. To obtain realistic estimates for $T_2$ from equation (14), the following condition should hold:

$$\delta>\frac{q_1\mu}{2\pi^{3/2}Kr*}\frac{1}{\Delta p_{\max}}u(\lambda) \tag{15}$$

Equation (15) expresses the condition that the target neighborhood of the final pressure should be greater than the residual transient left over from the investigation phase pretest.

In general, the estimates delivered by equations (10) and (14) for $V_2$ and $T_2$ may be used as starting values in a more comprehensive parameter estimation scheme utilizing equations (8) and (11).

The above described approach to determining the measurement phase pretest assumes that certain parameters will be assigned before the optimal pretest volume and duration can be estimated. These parameters include: the accuracy of the formation pressure measurement δ; the maximum drawdown permissible ($\Delta p_{max}$); the formation porosity ϕ—which will usually be available from openhole logs; and, the total compressibility $C_t$—which may be obtained from known correlations which in turn depend on lithology and porosity.

With the measurement phase pretest parameters determined, it should be possible to achieve improved estimates of the formation pressure and formation mobility within the time allocated for the entire test.

At point 350, the investigation phase ends and the measurement phase may begin. The parameters determined from the investigation phase are used to calculate the flow rate, the pretest duration and/or the volume necessary to determine the parameters for performing the measurement phase 14. The measurement phase 14 may now be performed using a refined set of parameters determined from the original formation parameters estimated in the investigation phase.

Figure 9:
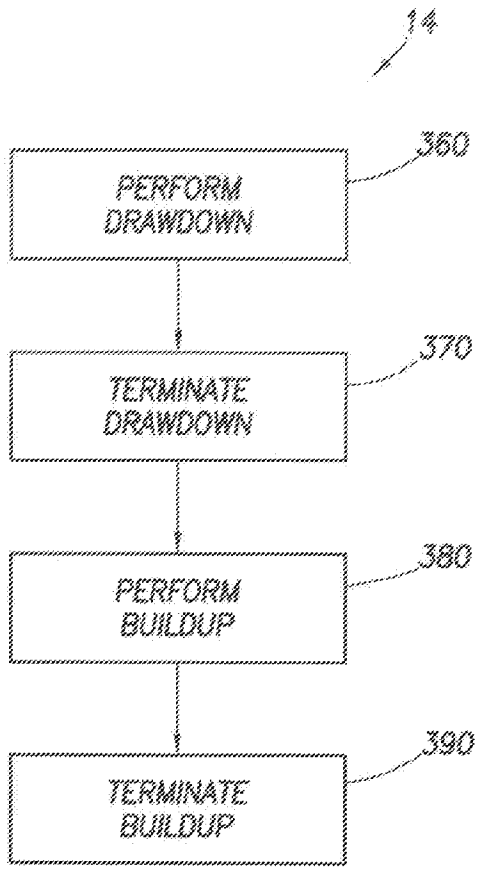
FIG. 9 shows a flow chart detailing the steps involved in performing the measurement phase of the flow chart of FIG. 3.

As shown in FIG. 9, the measurement phase 14 includes the steps of performing a second draw down 360, terminating the draw down 370, performing a second build up 380 and terminating the build up 390. These steps are performed as previously described according to the investigation phase 13 of FIG. 6. The parameters of the measurement phase, such as flow rate, time and/or volume, preferably have been predetermined according to the results of the investigation phase.

Referring back to FIG. 5, the measurement phase 14 preferably begins at the termination of the investigation phase 350 and lasts for duration $T_{MP}$ specified by the measurement phase until termination at point 390. Preferably, the total time to perform the investigation phase and the measurement phase falls within an allotted amount of time. Once the measurement phase is completed, the formation pressure may be estimated and the tool retracted for additional testing, downhole operations or removal from the wellbore.

Figure 10:
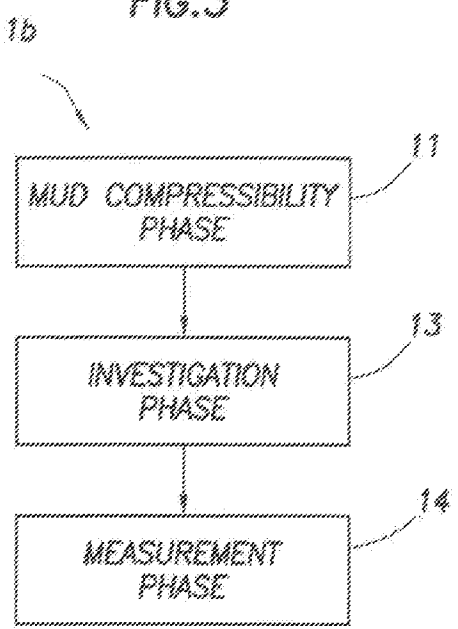
FIG. 10 shows a flow chart of steps involved in a pretest according to an embodiment of the invention incorporating a mud compressibility phase.
Figure 11A:
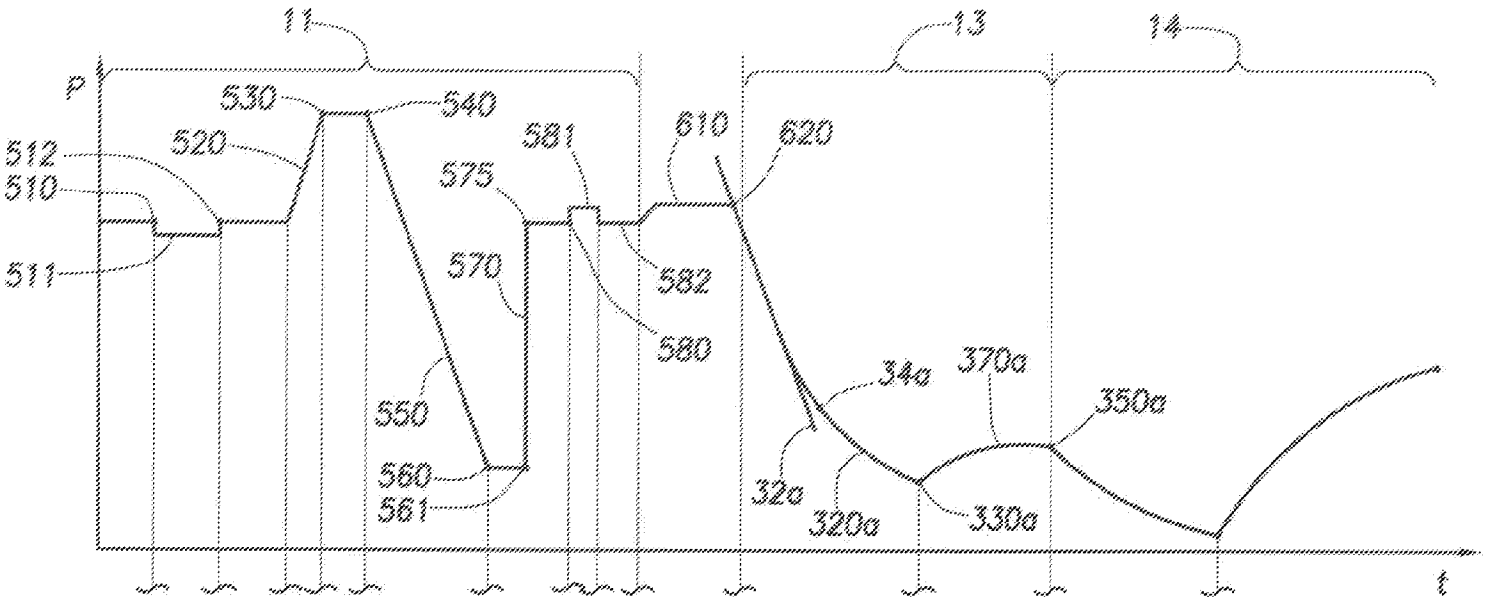
FIG. 11A shows a graphical representations of a pressure measurements versus time plot for performing the pretest of FIG. 10.
Figure 11B:
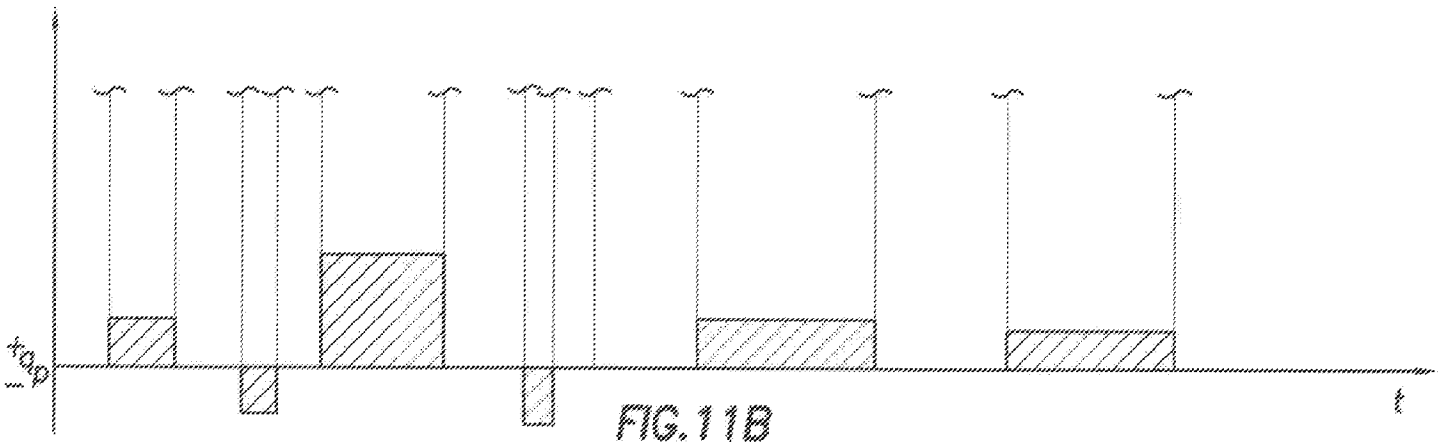
FIG. 11B shows the corresponding rate of change of volume.

Referring now to FIG. 10, an alternate embodiment of the method 1*a* incorporating a mud compressibility phase 11 is depicted. In this embodiment the method 1*b* comprises a mud compressibility phase 11, an investigation phase 13 and a measurement phase 14. Estimations of mud compressibility may be used to refine the investigation phase procedure leading to better estimates of parameters from the investigation phase 13 and the measurement phase 14. FIG. 11A depicts a pressure trace corresponding to the method of FIG. 10, and FIG. 11B shows a related graphical representation of the rate of change of the pretest chamber volume.

In this embodiment, the formation tester of FIG. 4 may be used to perform the method of FIG. 10. According to this embodiment, the isolation valves 121*a* and 124*a* may be used, in conjunction with equalizing valve 128*a*, to trap a volume of liquid in flowline 103*a*. In addition, the isolation valve 121*a* may be used to reduce tool storage volume effects so as to facilitate a rapid buildup. The equalizing valve 128*a* additionally allows for easy flushing of the flowline to expel unwanted fluids such as gas and to facilitate the refilling of the flowline sections 119*a* and 103*a* with wellbore fluid.

The mud compressibility measurement may be performed, for example, by first drawing a volume of mud into the tool from the wellbore through the equalization valve 128*a* by means of the pretest piston 118*a*, isolating a volume of mud in the flowline by closing the equalizing valve 128*a* and the isolation valves 121*a* and 124*a*, compressing and/or expanding the volume of the trapped mud by adjusting the volume of the pretest chamber 114*a* by means of the pretest piston 118*a* and simultaneously recording the pressure and volume of the trapped fluid by means of the pressure gauge 120*a*.

The volume of the pretest chamber may be measured very precisely, for example, by measuring the displacement of the pretest piston by means of a suitable linear potentiometer not shown in FIG. 4 or by other well established techniques. Also not shown in FIG. 4 is the means by which the speed of the pretest piston can be controlled precisely to give the desired control over the pretest piston rate $q_p$. The techniques for achieving these precise rates are well known in the art, for example, by use of pistons attached to lead screws of the correct form, gearboxes and computer controlled motors such rates as are required by the present method can be readily achieved.

Figures 12, 13:
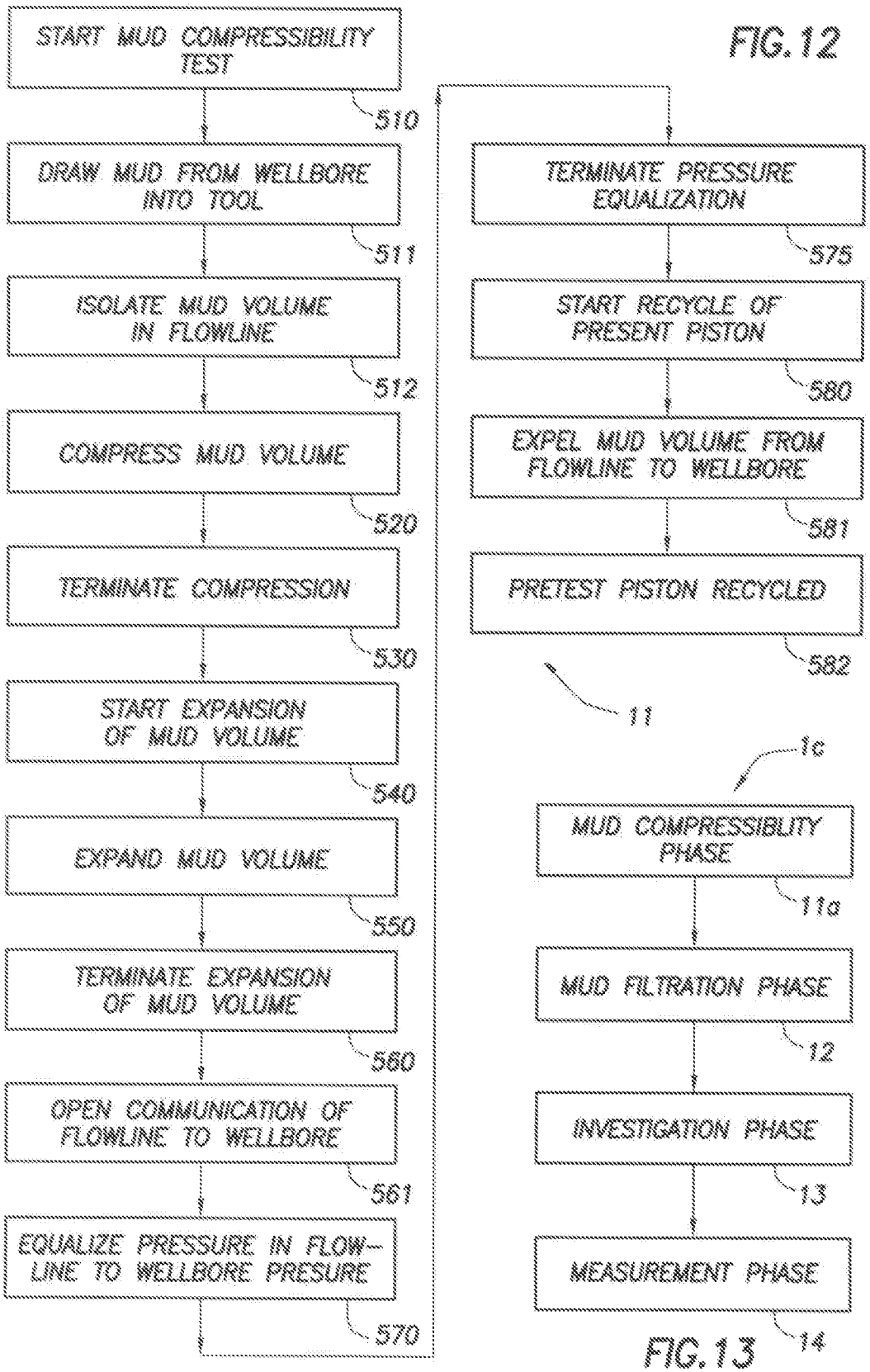
FIG. 12 shows a flow chart detailing the steps involved in performing the mud compressibility phase of the flow chart of FIG. 10.
FIG. 13 shows a flow chart of steps involved in a pretest according to an embodiment of the invention incorporating a mud filtration phase.

FIGS. 1A and 12 depict the mud compressibility phase 11 in greater detail. The mud compressibility phase 11 is performed prior to setting the tool and therefore prior to conducting the investigation and measurement phases. In particular, the tool does not have to be set against the wellbore, nor does it have to be immobile in the wellbore in order to conduct the mud compressibility test thereby reducing the risk of sticking the tool due to an immobilized drill string. It would be preferable, however, to sample the wellbore fluid at a point close to the point of the test.

The steps used to perform the compressibility phase 11 are shown in greater detail in FIG. 12. These steps also correspond to points along the pressure trace of FIG. 11A. As set forth in FIG. 12, the steps of the mud compressibility test include starting the mud compressibility test 510, drawing mud from the wellbore into the tool 511, isolating the mud volume in the flow line 512, compressing the mud volume 520 and terminating the compression 530. Next, the expansion of mud volume is started 540, the mud volume expands 550 for a period of time until terminated 560. Open communication of the flowline to wellbore is begun 561, and pressure is equalized in the flowline to wellbore pressure 570 until terminated 575. The pretest piston recycling may now begin 580. Mud is expelled from the flowline into the wellbore 581 and the pretest piston is recycled 582. When it is desired to perform the investigation phase, the tool may then be set 610 and open communication of the flowline with the wellbore terminated 620.

Mud compressibility relates to the compressibility of the flowline fluid, which typically is whole drilling mud. Knowledge of the mud compressibility may be used to better determine the slope of the line 32 (as previously described with respect to FIG. 7), which in turn leads to an improved determination of the point of deviation 34 signaling flow from the formation. Knowledge of the value of mud compressibility, therefore, results in a more efficient investigation phase 13 and provides an additional avenue to further refine the estimates derived from the investigation phase 13 and ultimately to improve those derived from the measurement phase 14.

Mud compressibility $C_m$ may be determined by analyzing the pressure trace of FIG. 11A and the pressure and volume data correspondingly generated. In particular, mud compressibility may be determined from, the following equation:

$$C_m = -\frac{1}{V}\frac{dV}{dp} \text{ or, equivalently, } q_P = -C_m V \dot{p} \tag{16}$$

where $C_m$ is the mud compressibility (1/psi), V is the total volume of the trapped mud ($cm^3$), p is the measured flowline pressure (psi), p is the time rate of change of the measured flowline pressure (psi/sec), and $q_p$ represents the pretest piston rate ($cm^3$/sec).

To obtain an accurate estimate of the mud compressibility, it is desirable that more than several data points be collected to define each leg of the pressure-volume trend during the mud compressibility measurement. In using equation (16) to determine the mud compressibility the usual assumptions have been made, in particular, the compressibility is constant and the incremental pretest volume used in the measurement is small compared to the total volume V of mud trapped in the flowline.

The utility of measuring the mud compressibility in obtaining a more precise deviation point 34*a* is now explained. The method begins by fitting the initial portion of the drawdown data of the investigation phase 13 to a line 32*a* of known slope to the data. The slope of line 32*a* is fixed by the previously determined mud compressibility, flowline volume, and the pretest piston drawdown rate. Because the drawdown is operated at a fixed and precisely controlled rate and the compressibility of the flowline fluid is a known constant that has been determined by the above-described experiment, the equation describing this line with a known slope is given by:

$$\begin{aligned} p(t) &= p^+ - \frac{q_p}{V(0)C_m}t \\ &= b - at \end{aligned} \tag{17}$$

where V(0) is the flowline volume at the beginning of the expansion, $C_m$ is the mud compressibility, $q_p$ is the piston decompression rate, $p^+$ is the apparent pressure at the initiation of the expansion process. It is assumed that V(0) is very much larger than the increase in volume due to the expansion of the pretest chamber.

Because the slope $\underline{\alpha}$ is now known the only parameter that needs to be specified to completely define equation (17) is the intercept $p^+$, ie., b. In general, $p^+$ is unknown, however, when data points belonging to the linear trend of the flowline expansion are fitted to lines with slope $\underline{\alpha}$ they should all produce similar intercepts. Thus, the value of intercept $p^+$ will emerge when the linear trend of the flowline expansion is identified.

A stretch of data points that fall on a line having the defined slope $\alpha$, to within a given precision, is identified. This line represents the true mud expansion drawdown pressure trend. One skilled in the art would appreciate that in fitting the data points to a line, it is unnecessary that all points fall precisely on the line. Instead, it is sufficient that the data points fit to a line within a precision limit, which is selected based on the tool characteristics and operation parameters. With this approach, one can avoid the irregular trend associated with early data points, i.e., those points around the start of pretest piston drawdown. Finally, the first point 34*a*, after the points that define the straight line, that deviates significantly (or beyond a precision limit) from the line is the point where deviation from the drawdown pressure trend occurs. The deviation 34*a* typically occurs at a higher pressure than would be predicted by extrapolation of the line. This point indicates the breach of the mudcake.

Various procedures are available for identifying the data points belonging to the flowline expansion line. The details of any procedure depend, of course, on how one wishes to determine the flowline expansion line, how the maximal interval is chosen, and how one chooses the measures of precision, etc.

Two possible approaches are given below to illustrate the details. Before doing so, the following terms are defined:

$$\bar{b}_k \equiv \frac{1}{N(k)}\left(\sum_{n=1}^{N(k)} p_n + a\sum_{n=1}^{N(k)} t_n\right) = \bar{p}_n + a\bar{t}_n \tag{18}$$

$$\hat{b}_k \equiv \underset{N(k)}{\text{median}}\,(p_k + at_k), \text{ and} \tag{19}$$

$$S_{p,k}^2 \equiv \frac{1}{N(k)}\sum_{n=1}^{N(k)} (p_n - p(t_n))^2 = \frac{1}{N(k)}\sum_{n=1}^{N(k)} (p_n - \bar{p}_k + a(t_n - \bar{t}_k))^2 \tag{20}$$

where, in general, N(k)<k represents the number of data points selected from the k data points ($t_k$, $p_k$) acquired. Depending on the context, N(k) may equal k. Equations (18) and (19) represent, respectively, the least-squares line with fixed slope α and the line of least absolute deviation with fixed slope α through N(k) data points, and, equation (20) represents the variance of the data about the fixed slope line.

One technique for defining a line with slope α spanning the longest time interval fits the individual data points, as they are acquired, to lines of fixed slope α. This fitting produces a sequence of intercepts $\{b_k\}$, where the individual $b_k$ are computed from: $b_k=p_k+\alpha t_k$. If successive values of $b_k$ become progressively closer and ultimately fall within a narrow band, the data points corresponding to these indices are used to fit the final line.

Specifically, the technique may involve the steps of: (i) determining a median, $\bar{b}_k$, from the given sequence of intercepts $\{b_k\}$; (ii) finding indices belonging to the set $l_k=\{i\in[2,\ldots,N(k)]\,|\,|b_i-\bar{b}_k|\leqq n_b\epsilon_b\}$ where $n_b$ is a number such as 2 or 3 and where a possible choice for $\epsilon_b$ is defined by the following equation:

$$\varepsilon_b^2 = S_{b,k}^2 = \frac{1}{N(k)}(S_{p,k}^2 + a^2 S_{t,k}^2) = \frac{1}{N(k)} S_{p,k}^2 \tag{21}$$

where the last expression results from the assumption that time measurements are exact.

Other, less natural choices for $\epsilon_b$ are possible, for example, $\epsilon_b=S_{p,k}$; (iii) fitting a line of fixed slope α to the data points with indices belonging to $l_k$; and (iv) finding the first point ($t_k$, $p_k$) that produces $p_k-b_k^*+\alpha t_k\geqq n_S S_{p,k}$, where $b_k^*=\hat{b}_k$ or $\bar{b}_k$ depending on the method used for fitting the line, and $n_S$ is a number such as 2 or 3. This point, represented by 34*a* on FIG. 11A, is taken to indicate a breach of the mudcake and the initiation of flow from the formation.

An alternate approach is based on the idea that the sequence of variances of the data about the line of constant slope should eventually become more-or-less constant as the fitted line encounters the true flowline expansion data. Thus, a method according to the invention may be implemented as follows: (i) a line of fixed slope, a, is first fitted to the data accumulated up to the time $t_k$. For each set of data, a line is determined from $p(t_k)=\bar{b}_k-\alpha t_k$, where $\bar{b}_k$ is computed from equation (18); (ii) the sequence of variances $\{S_{p,k}^2\}$ is constructed using equation (20) with N(k)=k; (iii) successively indices are found belonging to the set:

$$J_k = \left\{i \in [3, \ldots, k] \,\middle|\, S_{p,k-1}^2 - S_{p,k}^2 > \frac{1}{k} S_{p,k-1}^2 - (p_k - (\bar{b}_k - at_k))^2\right\};$$

(iv) a line of fixed slope α is fitted to the data with indices in $J_k$. Let N(k) be the number of indices in the set; (v) determine the point of departure from the last of the series of fixed-slope lines having indices in the above set as the first point that fulfills $p_k-\bar{b}_k+\alpha t_k>n_S S_{p,k}$, where $n_S$ is a number such as 2 or 3; (vi) define $$S_{\min}^2 = \min_{N(k)}\{S_{p,k}^2\};$$

(vii) find the subset of points of $J_k$ such that $N=\{i\in J_k\,|\,|p_i-(\bar{b}_i-\alpha t_i)|<S_{min}\}$; (viii) fit a line with slope α through the points with indices in N; and (ix) define the breach of the mudcake as the first point ($t_k$, $p_k$) where $p_k-\bar{b}_k+\alpha t_k>n_S S_{p,k}$. As in the previous option this point, represented again by 34*a* on FIG. 11A, is taken to indicate a breach of the mudcake and the initiation of flow from the formation.

Once the best fit line 32*a* and the deviation point 34*a* are determined, the termination point 330*a*, the build up 370*a* and the termination of buildup 350*a* may be determined as discussed previously with respect to FIG. 7. The measurement phase 14 may then be determined by the refined parameters generated in the investigation phase 13 of FIG. 11A.

Figure 14A:
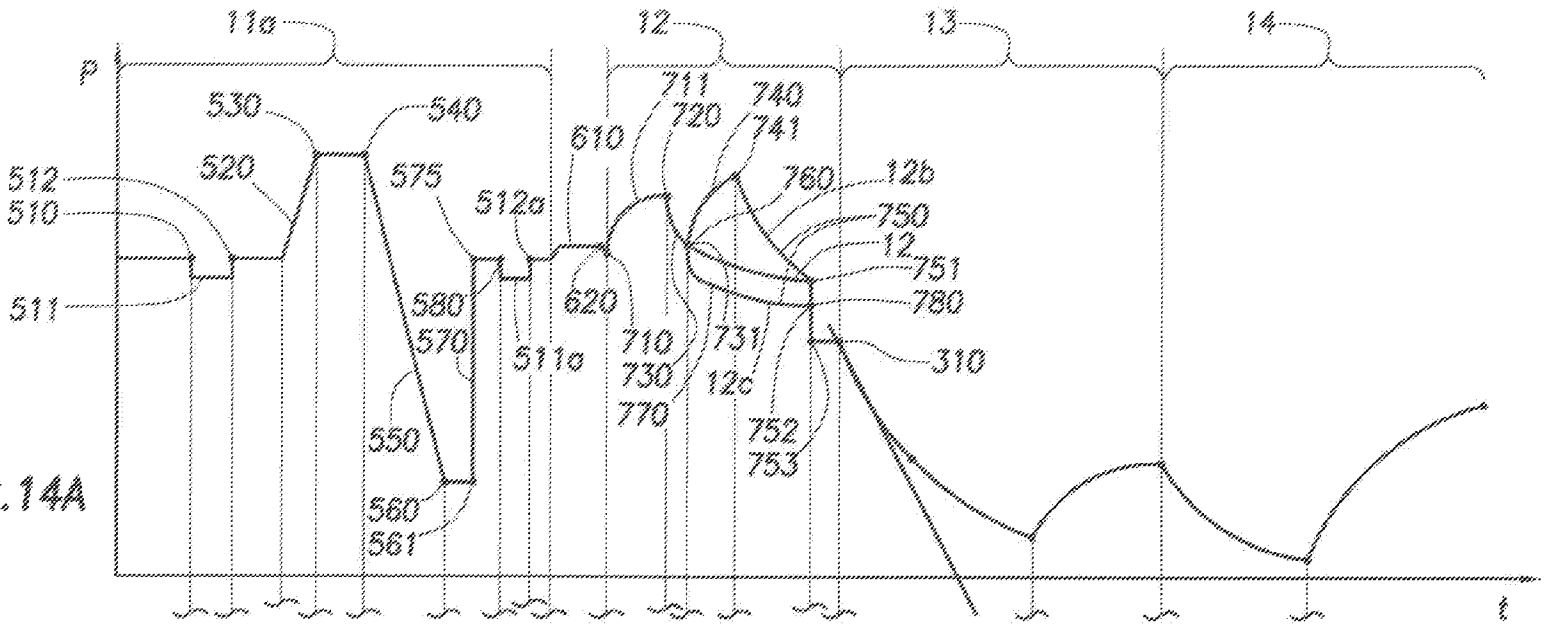
FIG. 14A shows a graphical representation of a pressure measurements versus time plot for performing the pretest of FIG. 13.
Figure 14B:
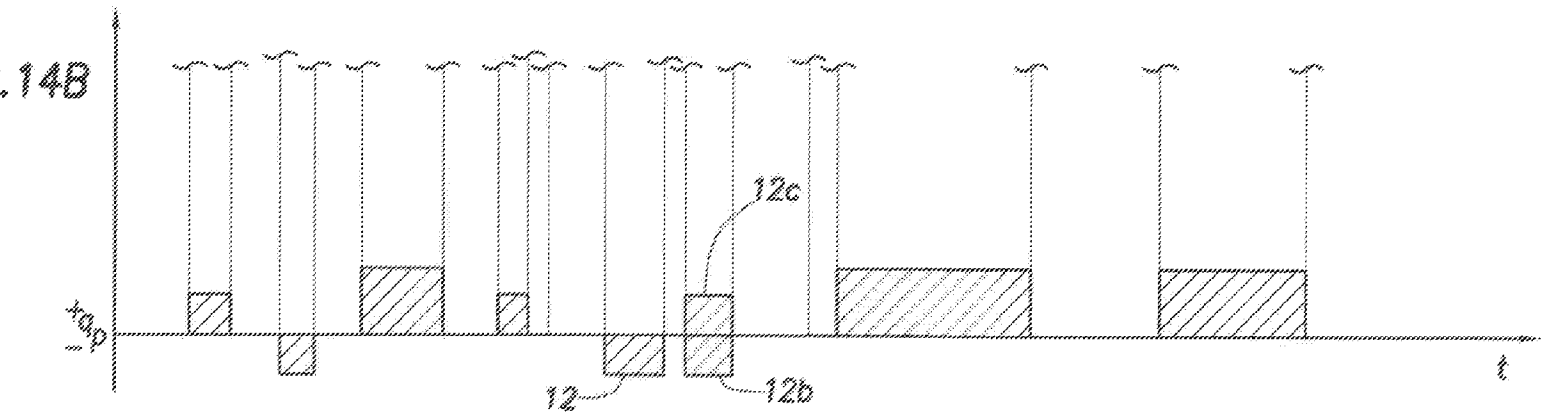
FIG. 14B shows the corresponding rate of change of volume.

Referring now to FIG. 13, an alternate embodiment of the method 1*c* incorporating a mud filtration phase 12 is depicted. In this embodiment the method comprises a mud compressibility phase 11*a*, a mud filtration phase 12, an investigation phase 13 and a measurement phase 14. The corresponding pressure trace is depicted in FIG. 14A, and a corresponding graphical depiction of the rate of change of pretest volume is shown in FIG. 14B. The same tool described with respect to the method of FIG. 10 may also be used in connection with the method of FIG. 13.

FIGS. 14A and 14B depict the mud filtration phase 12 in greater detail. The mud filtration phase 12 is performed after the tool is set and before the investigation phase 13 and the measurement phase 14 are performed. A modified mud compressibility phase 11*a* is performed prior to the mud filtration phase 12.

Figure 15:
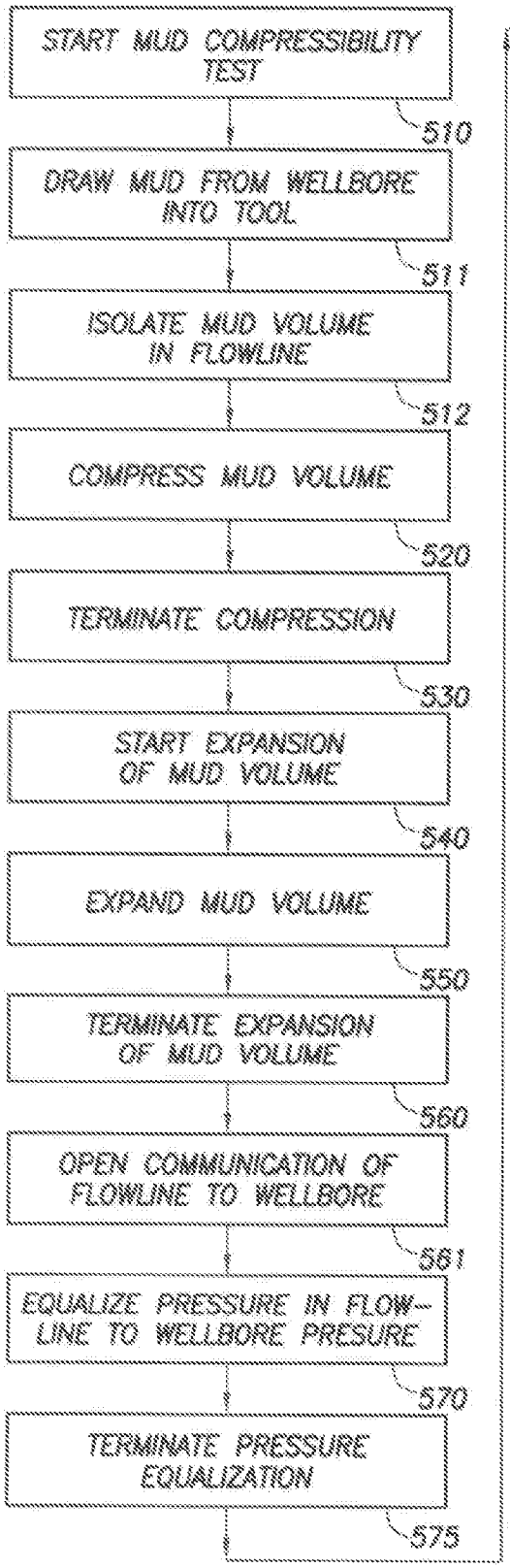
FIG. 15 shows the modified mud compressibility phase of FIG. 12 modified for use with the mud filtration phase.
Figure 15:
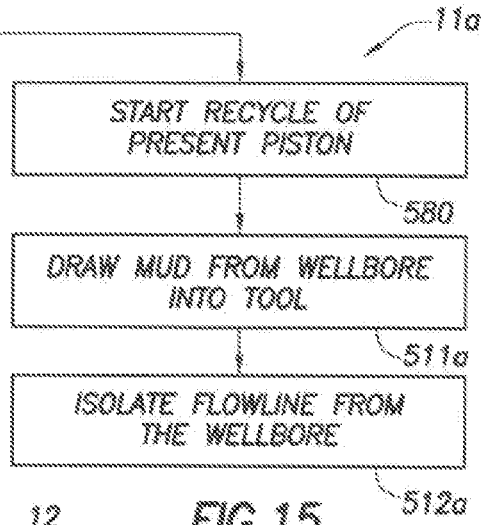

The modified compressibility test 11*a* is depicted in greater detail in FIG. 15. The modified compressibility test 11*a* includes the same steps 510-580 of the compressibility test 11 of FIG. 12. After step 580, steps 511 and 512 of the mud compressibility test are repeated, namely mud is drawn from the wellbore into the tool 511*a* and the flowline is isolated from the wellbore 512*a*. The tool may now be set 610 and at the termination of the set cycle the flowline may be isolated 620 in preparation for the mud filtration, investigative and measurement phases.

Figure 16A:
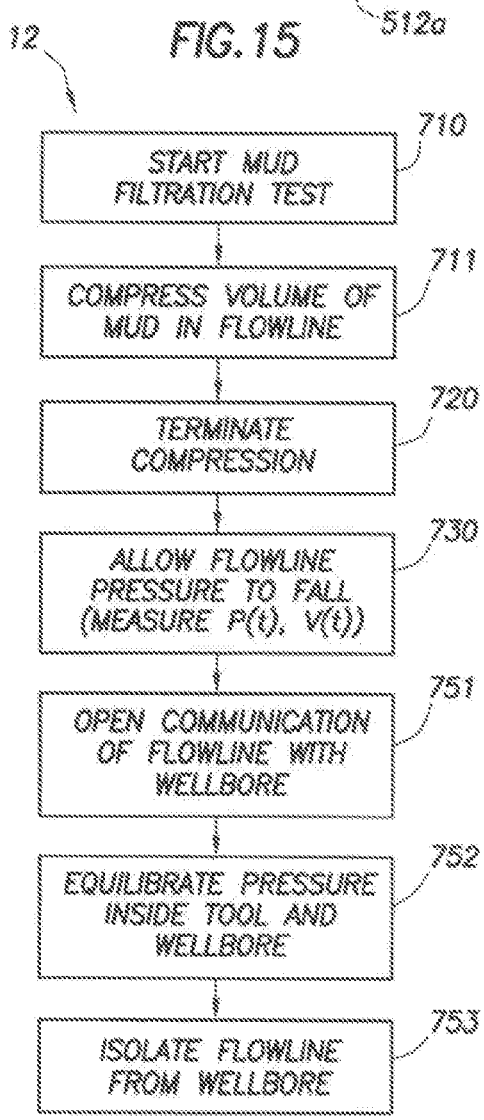
FIGS. 16A–C show flow chart detailing the steps involved in performing the mud filtration phase of the flow chart of FIG. 13.

The mud filtration phase 12 is shown in greater detail in FIG. 16A. The mud filtration phase is started at 710, the volume of mud in the flowline is compressed 711 until termination at point 720, and the flowline pressure falls 730. Following the initial compression, communication of the flowline within the wellbore is opened 751, pressures inside the tool and wellbore are equilibrated 752, and the flowline is isolated from the wellbore 753.

Figure 16B:
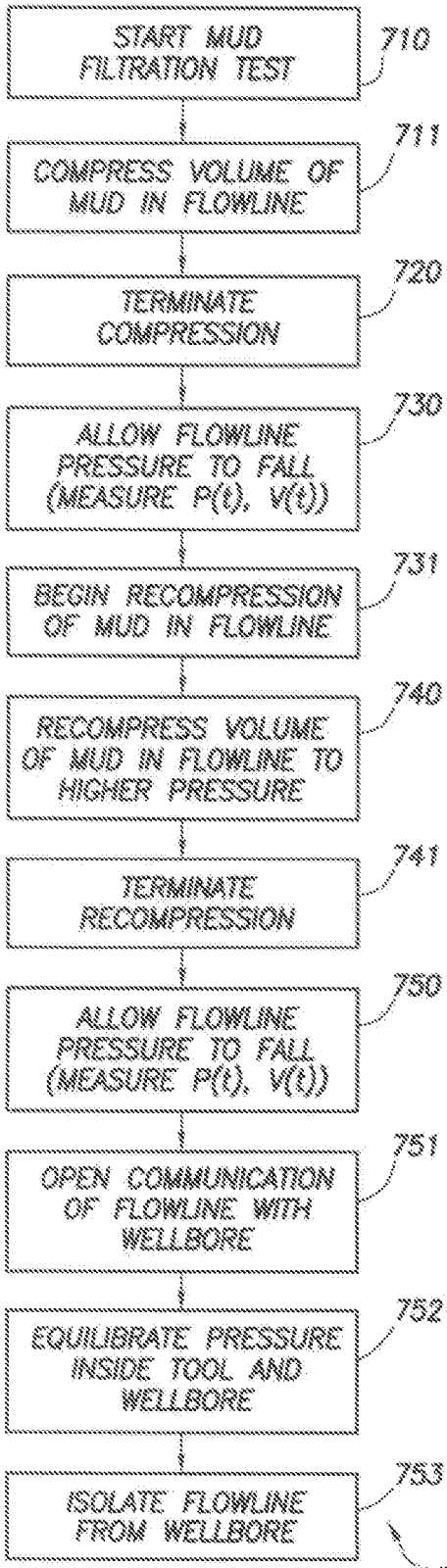

Optionally, as shown in FIG. 16B, a modified mud filtration phase 12*b* may be performed. In the modified mud filtration phase 12*b*, a second compression is performed prior to opening communication of the flowline 751, including the steps of beginning recompression of mud in flowline 731, compressing volume of mud in flowline to higher pressure 740, terminating recompression 741. Flowline pressure is then permitted to fall 750. Steps 751-753 may then be performed as described with respect to FIG. 16A. The pressure trace of FIG. 14A shows the mud filtration phase 12B of FIG. 16B.

Figure 16C:
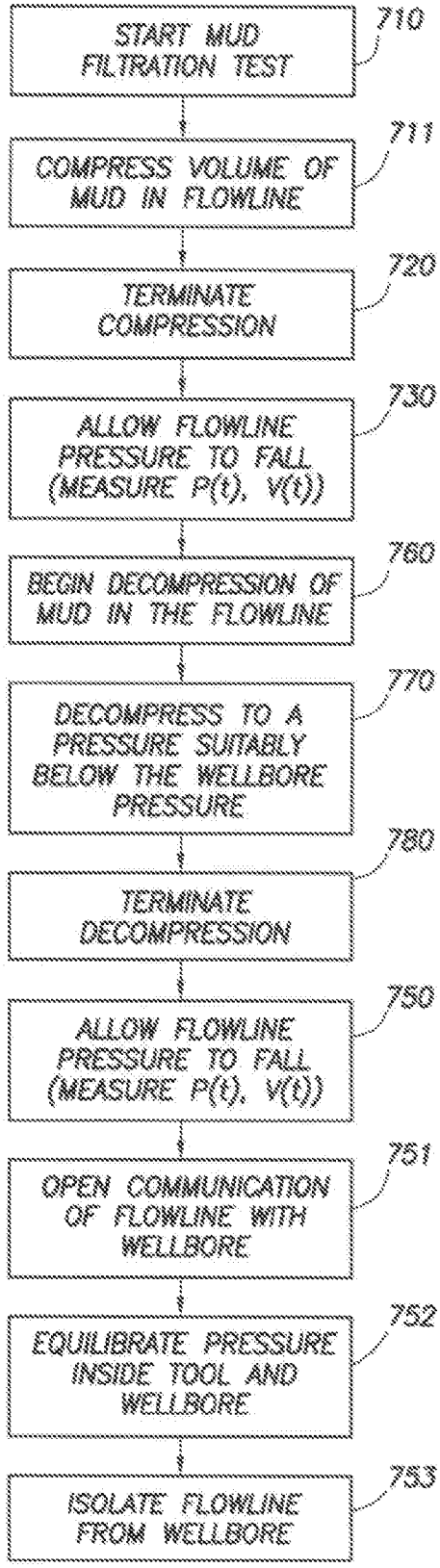

In another option 12*c* shown in FIG. 16C, a decompression cycle may be performed following flowline pressure fall 730 of the first compression 711, including the steps of beginning the decompression of mud in the flowline 760, decompressing to a pressure suitably below the wellbore pressure 770, and terminating the decompression 780. Flowline pressure is then permitted to fall 750. Steps 751-753 may then be repeated as previously described with respect to FIG. 16A. The pressure trace of FIG. 14A shows the mud filtration phase 12*c* of FIG. 16C.

As shown in the pressure trace of FIG. 14A, the mud filtration method 12 of FIG. 16A may be performed with either the mud filtration phase 12*b* of FIG. 16B or the mud filtration phase 12*c* of 16C. Optionally, one or more of the techniques depicted in FIGS. 16A–C may be performed during the mud filtration phase.

Mud filtration relates to the filtration of the base fluid of the mud through a mudcake deposited on the wellbore wall and the determination of the volumetric rate of the filtration under the existing wellbore conditions. Assuming the mudcake properties remain unchanged during the test, the filtration rate through the mudcake is given by the simple expression:

$$q_f = C_m V_t p \tag{22}$$

where $V_t$ is the total volume of the trapped mud ($cm^3$), and $q_f$ represents the mud filtration rate ($cm^3$/sec); $C_m$ represents the mud compressibility (1/psi) determined during the modified mud compressibility test 11*a*; p represents the rate of pressure decline (psi/sec) as measured during 730 and 750 in FIG. 14. The volume $V_t$ in equation (22) is a representation of the volume of the flowline contained between valves 121*a*, 124*a* and 128*a* as shown in FIG. 4.

For mud cakes which are inefficient in sealing the wellbore wall the rate of mud infiltration can be a significant fraction of the pretest piston rate during flowline decompression of the investigation phase and if not taken into account can lead to error in the point detected as the point of initiation of flow from the formation, 34 FIG. 7. The slope, a, of the fixed slope line used during the flowline decompression phase to detect the point of initiation of flow from the formation, ie the point of deviation, 34 FIG. 7, under these circumstances is determined using the following equation:

$$\begin{aligned} p(t) &= p^+ - \frac{q_p - q_f}{V(0)C_m} t \\ &= b - at \end{aligned}$$

where V(0) is the flowline volume at the beginning of the expansion, $C_m$ is the mud compressibility, $q_p$ is the piston decompression rate, $q_f$ is the rate of filtration from the flow line through the mudcake into the formation and $p^+$ is the apparent pressure at the initiation of the expansion process which, as previously explained, is determined during the process of determining the deviation point 34.

Once the mudcake filtration rate $q_f$ and the mud compressibility $C_m$ have been determined it is possible to proceed to estimate the formation pressure from the investigation phase 13 under circumstances where filtration through the mudcake is significant.

Preferably embodiments of the invention may be implemented in an automatic manner. In addition, they are applicable to both downhole drilling tools and to a wireline formation tester conveyed downhole by any type of work string, such as drill string, wireline cable, jointed tubing, or coiled tubing. Advantageously, methods of the invention permit downhole drilling tools to perform time-constrained formation testing in a most time efficient manner such that potential problems associated with a stopped drilling tool can be minimized or avoided.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for estimating a formation fluid mobility, comprising:

performing a pretest using a formation tester disposed in a formation penetrated by a borehole, the pretest comprising a drawdown phase and a buildup phase;

collecting data points representing pressures in a pretest chamber of the formation tester as a function of time during the drawdown phase and the buildup phase;

determining an estimated formation pressure from the data points;

determining an area bounded by a line passing through the estimated formation pressure and curves interpolating the data points during the drawdown phase and the buildup phase; and estimating the formation fluid mobility from the area, a volume extracted from the formation during the pretest, a radius of the formation testing probe, and a shape factor that accounts for the effect of the borehole on a response of the formation testing probe.

2. The method of claim 1, wherein the determining the estimated formation pressure is performed by finding a first data point which deviates from a linear trend representing a flowline decompression during the drawdown phase.

3. The method of claim 2, wherein the linear trend is identified by fitting the data points to a line with a fixed slope.

4. The method of claim 1, wherein the determining the estimated formation pressure is performed by finding a pressure that approximates a maximum buildup pressure.

5. The method of claim 1, wherein the estimating the formation fluid mobility is performed according to:

$$\left(\frac{K}{\mu}\right)_i = \frac{V_1}{4r_p}\frac{\Omega_S}{A} + \varepsilon_K$$

where K is the formation permeability and μis the formation fluid viscosity; $V_1$ is the volume extracted from the formation during the investigation pretest, $V_1=V(t_7+T_1)-V(t_7-T_0)=V(t_7)-V(t_7-T_0)$ where V is the volume of the pretest chamber; $r_p$ is the probe radius; $\epsilon_K$ is an error term, and A is the area defined by a region enclosed by the drawdown curve, a horizontal line at the pressure of termination and the buildup curve graphically depicted on a pressure versus time plot.

* * * * *